US008356376B2

(12) United States Patent
Mouri et al.

(10) Patent No.: US 8,356,376 B2
(45) Date of Patent: Jan. 22, 2013

(54) SUBSTRATE CLEANING APPARATUS, SUBSTRATE CLEANING METHOD, AND STORAGE MEDIUM

(75) Inventors: Nobuhiko Mouri, Koshi (JP); Satoru Tanaka, Tosu (JP)

(73) Assignee: Tokyo Electron Limited, Minato-Ku (JP)

( * ) Notice: Subject to any disclaimer, the term of this patent is extended or adjusted under 35 U.S.C. 154(b) by 501 days.

(21) Appl. No.: 12/472,495

(22) Filed: May 27, 2009

(65) Prior Publication Data

US 2009/0314311 A1 Dec. 24, 2009

(30) Foreign Application Priority Data

Jun. 18, 2008 (JP) ..... 2008-159031
Jun. 18, 2008 (JP) ..... 2008-159032
Jun. 18, 2008 (JP) ..... 2008-159033

(51) Int. Cl.
*B08B 1/00* (2006.01)
*B08B 1/04* (2006.01)
*A46B 13/00* (2006.01)

(52) U.S. Cl. ..... 15/77; 15/88.2; 134/6

(58) Field of Classification Search ..... 15/77
See application file for complete search history.

(56) References Cited

U.S. PATENT DOCUMENTS

| | | | | |
|---|---|---|---|---|
| 7,908,698 | B2 | 3/2011 | Idani | |
| 2007/0006895 | A1 | 1/2007 | Iwami et al. | |
| 2007/0226925 | A1 | 10/2007 | Hiraoka et al. | |
| 2008/0263793 | A1 * | 10/2008 | Nakano et al. | 15/77 |

FOREIGN PATENT DOCUMENTS

| | | | |
|---|---|---|---|
| CN | 1891355 | A1 | 1/2007 |
| CN | 101045230 | A1 | 10/2007 |
| JP | 04-331062 | A1 | 11/1992 |
| JP | 05-079939 | U1 | 10/1993 |
| JP | 11283952 | A * | 10/1995 |
| JP | 10-223597 | A1 | 8/1998 |
| JP | 11-283952 | A1 | 10/1999 |
| JP | 2002-050602 | A1 | 2/2002 |
| JP | 2003-151943 | A1 | 5/2003 |
| JP | 2007-165794 | A1 | 6/2007 |
| JP | 2007-194244 | A1 | 8/2007 |

OTHER PUBLICATIONS

Japanese Office Action (Japanese Application No. 2008-159031) dated Dec. 20, 2011 (with English translation).
Japanese Office Action (Japanese Application No. 2008-159032) dated Dec. 20, 2011 (with English translation).
Japanese Office Action (Japanese Application No. 2008-159033) dated Dec. 20, 2011 (with English translation).

* cited by examiner

*Primary Examiner* — Monica Carter
*Assistant Examiner* — Stephanie N Berry
(74) *Attorney, Agent, or Firm* — Burr & Brown

(57) ABSTRACT

To provide a substrate cleaning apparatus capable of effectively removing deposits adhering to at least an end surface of a substrate by means of a sponge-like brush. A substrate cleaning apparatus includes: a spin chuck configured to rotatably hold a substrate W; a motor configured to rotate the substrate W held by the spin chuck; a cleaning-liquid supply mechanism configured to supply a cleaning liquid to the substrate W held by the spin chuck. The cleaning mechanism includes: a brush made of a sponge-like resin, which is brought into contact with at least an end surface of the wafer W during the cleaning; and a brush compressing mechanism configured to compress the brush. The brush is compressed by the compressing mechanism, and cleans at least the end surface of the substrate W.

21 Claims, 17 Drawing Sheets

SUBSTRATE CLEANING APPARATUS, SUBSTRATE CLEANING METHOD, AND STORAGE MEDIUM

BACKGROUND OF THE INVENTION

1. Field of the Invention

The present invention relates to a substrate cleaning apparatus, a substrate cleaning method, and a storage medium, for cleaning at least an end surface of a substrate.

2. Description of Related Art

In a manufacture of a semiconductor device and a manufacture of a flat panel display (FPD), there is performed a cleaning process for removing, from an object to be processed such as a semiconductor wafer and a glass substrate, particles and contaminations adhering thereto. As an apparatus for performing such a cleaning process, there is known a cleaning apparatus of a single-wafer type, which holds a substrate on a spin chuck, and supplies a cleaning liquid to a surface of the wafer while rotating the substrate, so as to clean the surface of the wafer.

In a cleaning process performed by such a cleaning apparatus, there is a possibility that an acid chemical liquid and/or an alkaline chemical liquid, which has been used as a cleaning liquid and remains on a peripheral portion of the substrate in the course of the cleaning process, might be dried to become deposits, and/or a matter removed by the cleaning might again adhere to the peripheral portion of the substrate. In former times, since the peripheral portion of the substrate is not used as a product, no special countermeasure is taken against the deposits on the peripheral portion of the substrate. However, in accordance with a further miniaturization of a device, an adverse effect of deposits becomes actual. For example, deposits on the peripheral portion of the substrate may adhere to a substrate support arm or the like of a substrate transfer mechanism. In order to prevent the adverse effect, there has been proposed a technique for removing deposits on a peripheral portion of a substrate by bringing a sponge-like brush into contact with the peripheral portion of the substrate (for example, Patent Documents 1 and 2).

However, since some of deposits firmly adhere to the peripheral portion of the substrate, in particular, to an end surface of the substrate, there is a possibility that these deposits may not be removed only by bringing the sponge-like brush into contact with the substrate.

[Patent Document 1] JP5-79939U

[Patent Document 2] JP2007-165794A

SUMMARY OF THE INVENTION

The present invention has been made in view of the above circumstances. The object of the present invention is to provide a substrate cleaning apparatus and a substrate cleaning method capable of effectively removing deposits adhering to at least an end surface of a substrate by means of a sponge-like brush.

In addition, the further object of the present invention is to provide a storage medium storing a program for performing such a method.

[1] The present invention is a substrate cleaning apparatus for cleaning a substrate having an end surface, a front peripheral portion and a rear peripheral portion, the substrate cleaning apparatus comprising: a substrate holding mechanism configured to rotatably hold a substrate; a substrate rotating mechanism configured to rotate the substrate held by the substrate holding mechanism; a cleaning-liquid supply mechanism configured to supply a cleaning liquid to the substrate held by the substrate holding mechanism; and a cleaning mechanism including a brush made of a sponge-like resin, which is brought into contact with at least an end surface of the substrate during the cleaning, and a brush compressing mechanism configured to compress the brush; wherein the brush cleans at least the end surface of the substrate, under a state in which the brush is compressed and hardened by the brush compressing mechanism.

[2] The present invention is the substrate cleaning apparatus of [1], wherein: the brush includes a cylindrical small-diameter part and a cylindrical large-diameter part continuous to the small-diameter part; the end surface of the substrate is cleaned by a circumferential surface of the small-diameter part; and the rear peripheral portion or the front peripheral portion of the substrate is cleaned by a connection surface between the large-diameter part and the small-diameter part.

[3] The present invention is the substrate cleaning apparatus of [2], wherein the connection surface between the large-diameter part and the small-diameter part is deformed by compressing the brush, and the rear peripheral portion or the front peripheral portion of the substrate is locally cleaned by the deformed part.

[4] The present invention is the substrate cleaning apparatus of [2], wherein an initial shape of the brush is determined such that an excellent cleaning force for the end surface and the front peripheral portion or the rear peripheral portion of the substrate is provided, when the brush is compressed by the brush compressing mechanism.

[5] The present invention is the substrate cleaning apparatus of [4], wherein the initial shape of the brush has, between the small-diameter part and the large-diameter part, a cutout into which the substrate can be inserted.

[6] The present invention is the substrate cleaning apparatus of [4], wherein the initial shape of the brush has a curved part between the small-diameter part and the large-diameter part.

[7] The present invention is the substrate cleaning apparatus of [1], wherein the brush has a cylindrical shape, and the end surface of the substrate is cleaned by an outer circumferential surface of the brush.

[8] The present invention is the substrate cleaning apparatus of [7], wherein an initial shape of the brush is determined such that an excellent cleaning force for at least the end surface of the substrate is provided, when the brush is compressed by the brush compressing mechanism.

[9] The present invention is the substrate cleaning apparatus of [8], wherein the initial shape of the brush has, in an outer circumference thereof, a cutout into which the substrate can be inserted.

[10] The present invention is the substrate cleaning apparatus of[1], wherein the brush compressing mechanism includes a pair of pressing members configured to vertically sandwich the brush therebetween, and an actuator configured to move at least one of the pressing members.

[11] The present invention is the substrate cleaning apparatus of [1]wherein: the cleaning mechanism includes a brush rotating mechanism configured to rotate the brush, and a brush moving mechanism configured to move the brush close to and apart from the substrate; and the brush, which is rotated by the brush rotating mechanism, is brought into contact with the substrate, which is rotated by the substrate rotating mechanism, by the brush moving mechanism so that at least the end surface of the substrate is cleaned under this state.

[12] The present invention is the substrate cleaning apparatus of [1], further comprising a control part configured to control the brush cleaning, by varying a compressive force applied by the brush compressing mechanism to the brush.

[13] The present invention is the substrate cleaning apparatus of [12], wherein; the brush has a cylindrical small-diameter part and a large-diameter part having a connection surface between the large-diameter part and the small-diameter part; the connection surface between the large-diameter part and the small-diameter part is deformed by compressing the brush; the front peripheral portion or the rear peripheral portion of the substrate can be locally cleaned by the deformed part; and the control part controls a position of the deformed part by varying the compressive force applied by the brush compressing mechanism.

[14] The present invention is the substrate cleaning apparatus of [12], wherein the control part controls the brush cleaning by varying the compressive force to the brush by the brush compressing mechanism during the cleaning of the substrate.

[15] The present invention is the substrate cleaning apparatus of [12], wherein the control part controls the brush cleaning by varying the compressive force to the brush depending on a state of the substrate to be cleaned.

[16] The present invention is the substrate cleaning apparatus of [1], wherein the brush compressing mechanism includes a brush-shape deforming member configured be in contact with the brush so as to deform a shape of the brush into a predetermined shape.

[17] The present invention is the substrate cleaning apparatus of [16], wherein: the brush includes a cylindrical small-diameter part and a cylindrical large diameter part having a connection surface between the large-diameter part and the small-diameter part; and the brush-shape deforming member deforms the connection surface into a predetermined state such that a desired cleaning can be achieved.

[18] The present invention is the substrate cleaning apparatus of [16], wherein a contact surface of the brush-shape deforming member to be in contact with the brush has a concaved shape.

[19] The present invention is the substrate cleaning apparatus of [16], wherein a contact surface of the brush-shape deforming member to be in contact with the brush has a conical shape.

[20] The present invention is the substrate cleaning apparatus of [16], wherein a contact surface of the brush-shape deforming member to be in contact with the brush has an asymmetric shape with respect to a rotational axis of the brush.

[21] The present invention is a substrate cleaning method for cleaning a substrate having an end surface, a front peripheral portion, and a rear peripheral portion, the substrate cleaning method comprising: compressing and hardening a brush made of a sponge-like resin by a brush compressing mechanism; supplying a cleaning liquid to a substrate; and cleaning the substrate by bringing the hardened brush into contact with at least an end surface of the substrate.

[22] The present invention is the substrate cleaning method of [21], wherein: the brush is compressible; and the brush cleaning is controlled by varying a compressive force to the brush during the cleaning.

[23] The present invention is the substrate cleaning method of [21], wherein: the brush compressing mechanism includes a brush-shape deforming member; and a shape of the brush is deformed into a predetermined shape by bringing the brush-shape deforming member into contact with the brush; and the substrate is cleaned by bringing the deformed brush into contact with the end surface and a front peripheral portion or a rear peripheral portion of the substrate.

[24] The present invention is a storage medium including a computer program executable by a computer to perform a substrate cleaning method for cleaning a substrate having an end surface, a front peripheral portion, and a rear peripheral portion, the substrate cleaning method comprising: a step of compressing and hardening a brush made of a sponge-like resin by a brush compressing mechanism; a step of supplying a cleaning liquid to a substrate; and a step of cleaning the substrate by bringing the hardened brush into contact with at least an end surface of the substrate.

According to the present invention, when a substrate is cleaned by a sponge-like brush by pressing the brush onto at least an end surface of the substrate, the brush is compressed. Thus, a hardness of the brush is increased during the cleaning so that a cleaning force of the brush can be increased, whereby deposits adhering to the end surface of the substrate can be effectively cleaned. When there is used a brush having a small-diameter part and a large-diameter part, which are continuous to each other, for simultaneously cleaning an end surface of a substrate and a front peripheral portion or a rear peripheral portion of the substrate, a projecting part having a higher hardness is formed by compressing the brush on a connection surface between the large-diameter part and the small-diameter part for cleaning the peripheral portion. Thus, a substrate can be locally cleaned by such a projecting part having a significantly increased cleaning force.

According to the present invention, when a substrate is cleaned by a brush by pressing the brush onto at least an end surface of the substrate, a brush made of a sponge-like resin is used. The brush can be compressed by a brush compressing mechanism, and the brush cleaning is controlled by varying a compressive force to the brush. Thus, the brush cleaning can be optimized, and deposits adhering to at least the end surface of the substrate can be effectively removed.

For example, by controlling the cleaning by varying the compressive force to the brush during the cleaning of the substrate, the cleaning force can be controlled with time. To be specific, it is possible to employ a method in which deposits which can be easily removed are firstly removed by the brush to which no compressive force is applied, and then deposits firmly adhering to the substrate are removed by gradually increasing the compressive force so as to increase the cleaning force. In addition, a cleaning position can be controlled. To be specific, there is used a brush having a cylindrical small-diameter part and a cylindrical large-diameter part that is continuous to the small-diameter part. A connection surface between the large-diameter part and the small-diameter part is deformed by a brush compressing mechanism, and a peripheral portion of the substrate is locally cleaned by the deformed part. In this manner, by varying a compressive force to the brush, a cleaning position can be controlled so that deposits firmly adhering to a peripheral portion of the substrate can be effectively removed.

In addition, it is possible to control the brush cleaning, by varying a compressive force to the brush, depending on a state of a substrate. To be specific, depending on a type of the substrate and a state of the substrate such as deposits adhering thereto, the cleaning is controlled by varying the compressive force to the brush. Thus, the brush cleaning can be appropriately performed depending on a state of a substrate.

According to the present invention, when a substrate is cleaned by pressing a brush onto a peripheral portion and an end surface of a substrate, a sponge-like brush is used. A brush holding mechanism has a brush-shape deforming member that can be in contact with the brush so as to deform a shape of the brush into a predetermined shape. Thus, the shape of the brush can be appropriately varied depending on deposits adhering to the substrate to be cleaned, whereby an appropriate and effective cleaning can be performed.

DETAILED DESCRIPTION OF THE INVENTION

First Embodiment

Figure 1:
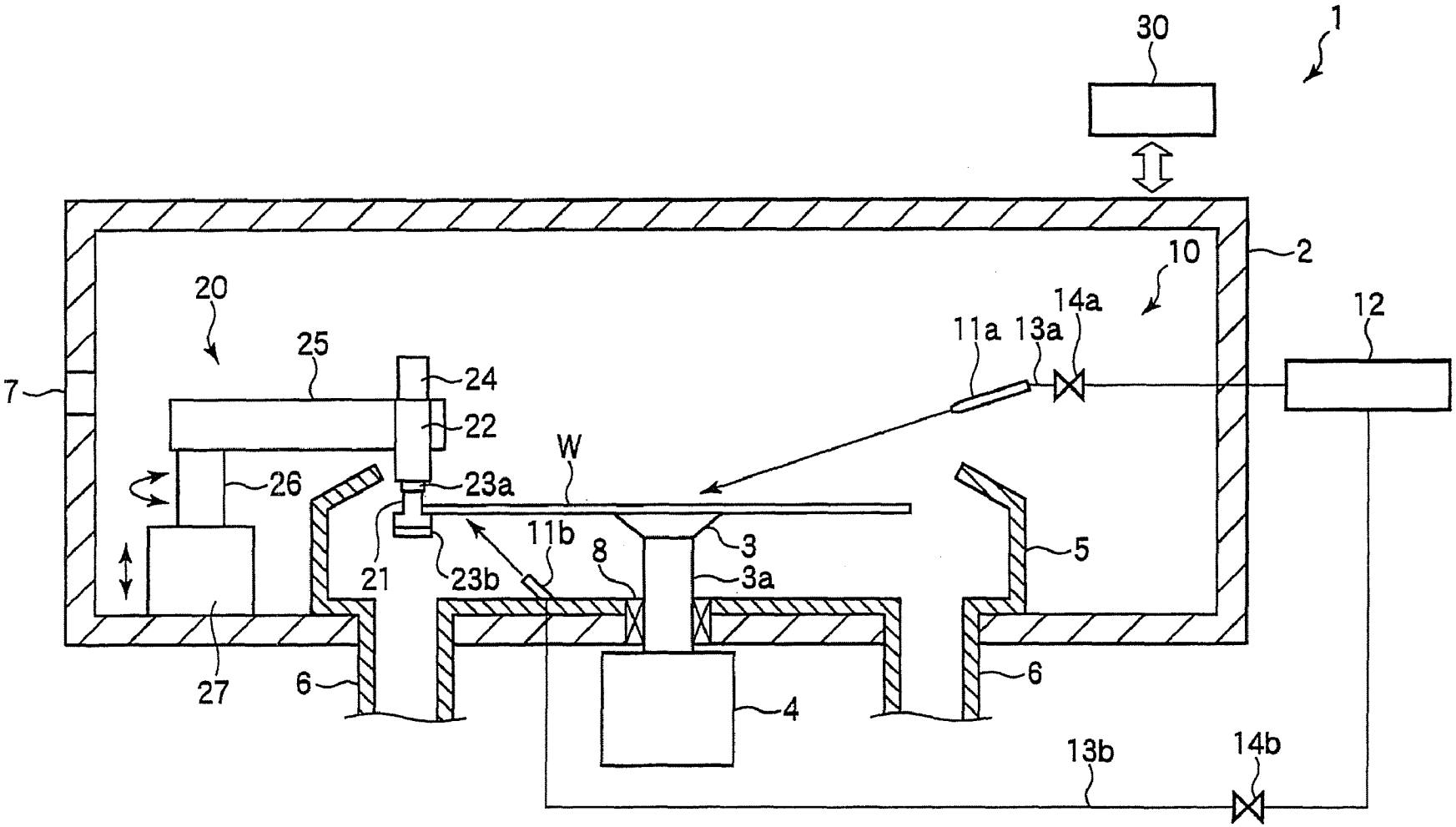
FIG. 1 is a schematic structural view showing a substrate cleaning apparatus in a first embodiment according to the present invention.
Figure 2:
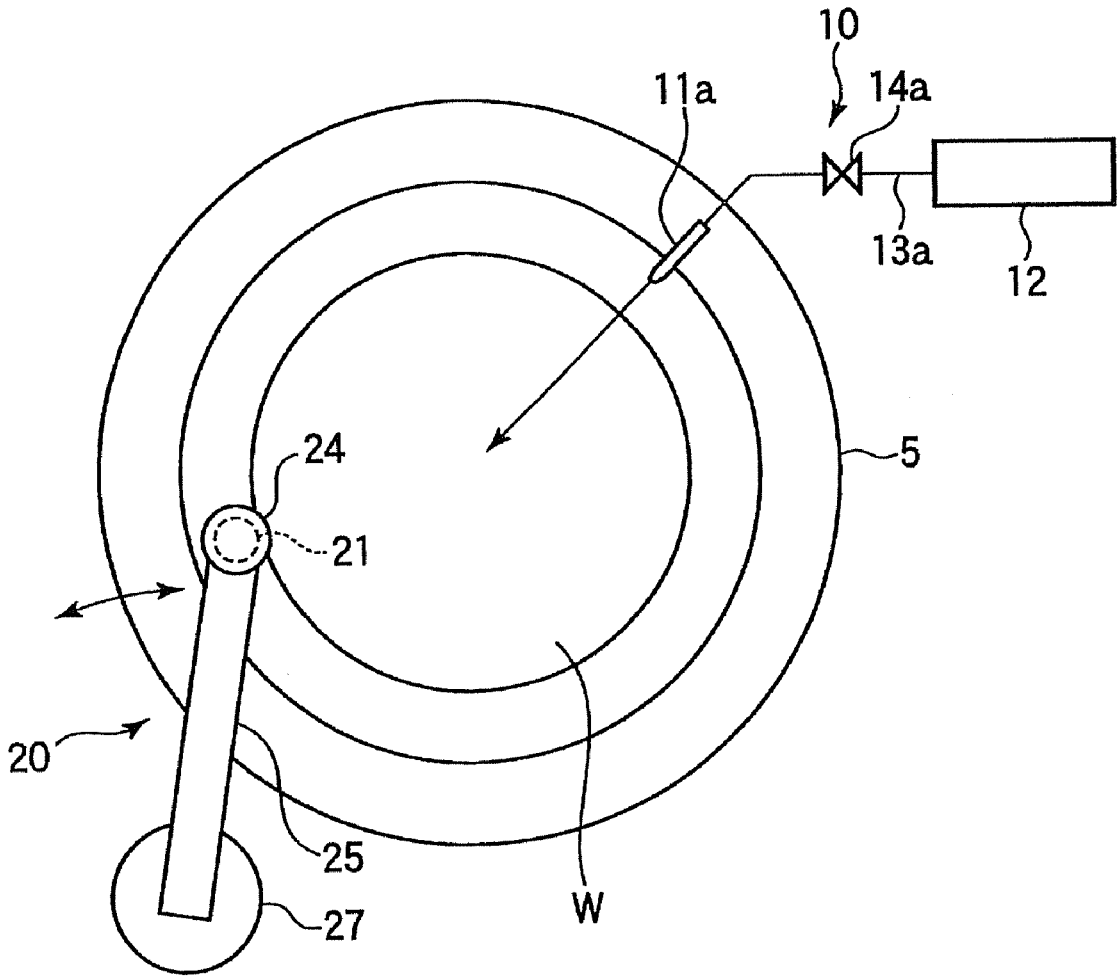
FIG. 2 is a plan view showing an inside of the substrate cleaning apparatus in the first embodiment according to the present invention.

A first embodiment of the present invention is described concretely below with reference to the accompanying drawings. FIG. 1 is a schematic structural view showing a wafer cleaning apparatus in a first embodiment according to the present invention. FIG. 2 is a plan view showing an inside thereof.

The wafer cleaning apparatus 1 includes a chamber 2. Disposed in the chamber 2 is a spin chuck 3 configured to horizontally absorb and support a semiconductor wafer (hereinafter simply referred to as "wafer") W as a substrate to be cleaned by a vacuum absorption. The spin chuck 3 is capable of being rotated through a shaft 3*a* by a motor 4 disposed below the chamber 2. In the chamber 2, a cup 5 is disposed so as to surround a wafer W held by the spin chuck 3. A pipe 6 for discharging an air and a liquid is extended downward the chamber 2 from a bottom part of the cup 5. A loading and unloading port 7 for loading and unloading a wafer W is formed in a sidewall of the chamber 2. A fluid seal 8 is disposed between the shaft 3*a* and the bottom part of the cup 5, and between the shaft 3*a* and a bottom part of the chamber 2.

The wafer cleaning apparatus 1 is further provided with a cleaning-liquid supply mechanism 10 configured to supply a cleaning liquid, and a cleaning mechanism 20 configured to brush-clean a peripheral portion including an end surface of a wafer W.

The cleaning-liquid supply mechanism 10 includes a front-side cleaning-liquid nozzle 11*a* disposed above the cup 5, and a rear-side cleaning-liquid nozzle 11*b* disposed on a rear side of a wafer W held by the spin chuck 3. Connected to these front-side cleaning-liquid nozzle 11*a* and the rear-side cleaning-liquid nozzle 11*b* are a front-side cleaning-liquid supply pipe 13*a* and a rear-side cleaning-liquid supply pipe 13*b*, respectively. Other ends of these front-side cleaning-liquid supply pipe 13*a* and the rear-side cleaning-liquid supply pipe 13*b* are connected to a common cleaning-liquid supply source 12. A cleaning liquid is supplied from the cleaning-liquid supply source 12 onto a part near a center of a front surface of a wafer W through the front-side cleaning-liquid supply pipe 13*a* and the front-side cleaning-liquid nozzle 11*a*. A cleaning liquid is supplied from the cleaning-liquid supply source 12 onto a rear surface of a wafer W through the rear-side cleaning-liquid supply pipe 13*b* and the rear-side cleaning-liquid nozzle 11*b*. The front-side cleaning-liquid supply pipe 13*a* and the rear-side cleaning-liquid supply pipe 13*b* are equipped with valves 14*a* and 14*b*, respectively. A deionized water and a chemical liquid may be used as a cleaning liquid.

The cleaning mechanism 20 includes: a brush 21 made of a sponge-like resin, the brush 21 being configured to clean a peripheral portion and an end surface of a wafer W; a rotational support member 22 configured to rotatably support the brush 21; a pair of pressing members 23*a* and 23*b* configured to press the brush 21 in an up and down direction (in a vertical direction); a cylinder 24 configured to impart a compressive force to the brush 21 through the pressing members 23*a* and 23*b*; a turning arm 25 configured to turn the brush 21; a shaft part 26 incorporating a turning shaft serving as a turning axis of the turning arm 25; and a turning and elevating part 27 incorporating a turning mechanism configured to turn the turning arm 25 by rotating the turning shaft, and an elevating mechanism configured to elevate and lower (vertically move) the turning arm 25.

Figure 3:
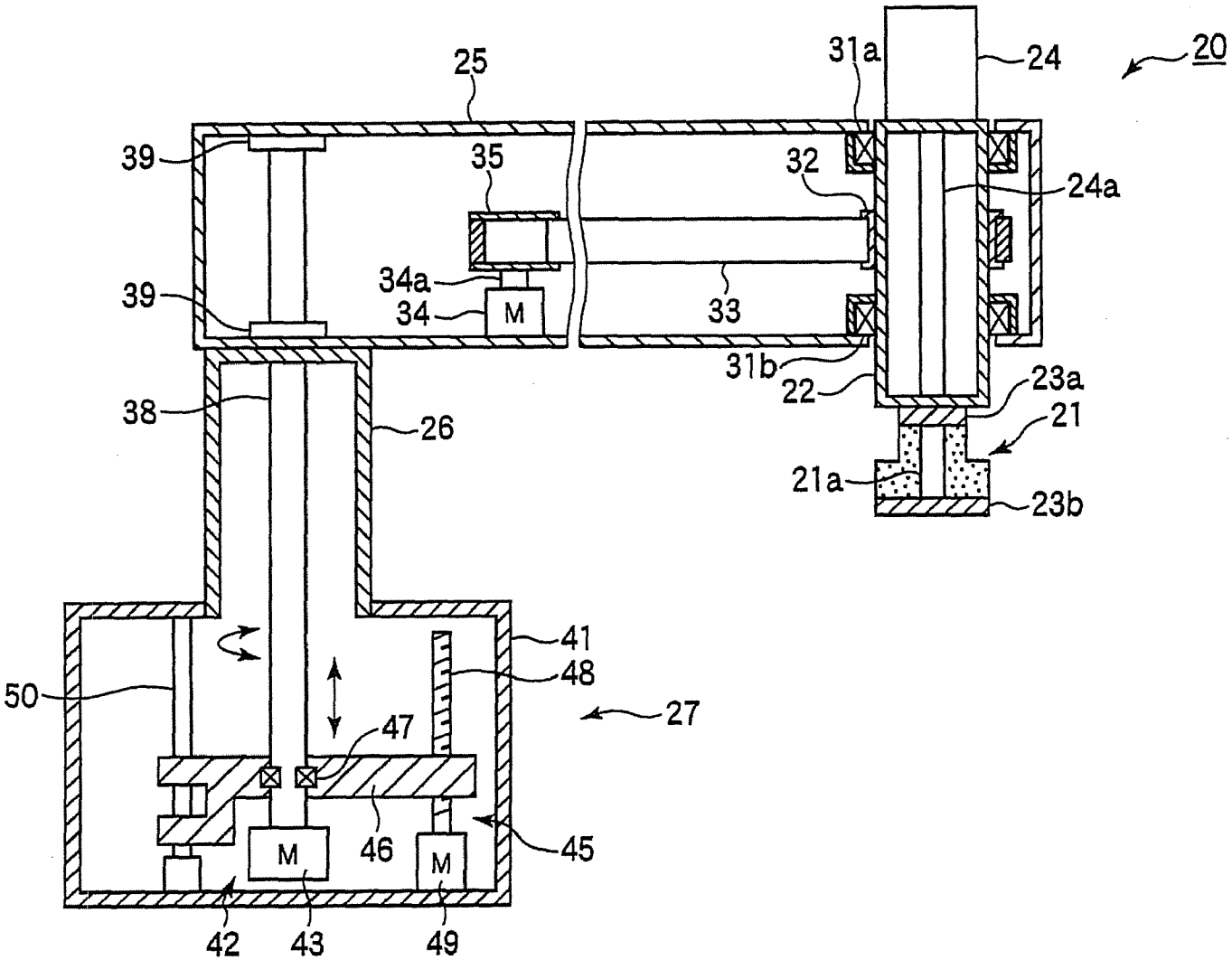
FIG. 3 is a sectional view showing in more detail a cleaning mechanism provided on the substrate cleaning apparatus in the first embodiment according to the present invention.

FIG. 3 is a sectional view showing in more detail the cleaning mechanism. The rotational support member 22 has a cylindrical shape that is vertically extended. A piston 24*a* of the cylinder 24 vertically passes an inside of the rotational support member 22. Connected to the piston 24*a* is a brush support member 21*a* that is vertically extended in a center of the brush 21. A lower end of the brush support member 21*a* is fixed on a center of the lower pressing member 23*b*. The upper pressing member 23*a* is fixed on a lower end surface of the rotational support member 22, and a part between the brush support member 21*a* and the upper pressing member 23*a* is free. Thus, when the piston 24*a* of the cylinder 24 is withdrawn, the lower pressing member 23*b* is elevated together with the brush support member 21*a*, so that the brush. 21 sandwiched between the upper pressing member 23*a* and the lower pressing member 23*b* is compressed. Namely, the pressing members 23*a* and 23*b* and the cylinder 24 function as a brush compressing mechanism. Both of the pressing members 23*a* and 23*b* may be moved to compress the brush 21. In addition, another actuator may be used instead of the cylinder 24.

The turning arm 25 has a square-cylindrical shape that is horizontally extended. The rotational support member 22 is rotatably disposed on a distal end part of the turning arm 25. Namely, the rotational support member 22 is rotatably supported by a pair of bearings 31*a* and 31*b* disposed on the turning arm 25. A pulley 32 is externally fitted to a central part of the rotational support member 22, and a belt 33 is wound round the pulley 32. The belt 33 is horizontally extended in an inside space of the turning arm 25. Inside the turning arm 25, there is disposed a brush rotating motor 34 that is fixed on a bottom plate of the turning arm 25. A pulley 35 is disposed on a rotational shaft 34*a* of the brush rotating motor 34, and the belt 33 is wound round the pulley 35. Thus, by driving the motor 34, the rotational support member 22 is rotated through the belt 33, whereby the brush 21 is rotated.

To a proximal end part of the turning arm 25, there is fixed a turning shaft 38 that is vertically extended, by a pair of fixing members 39 disposed on an upper part and a lower part inside the turning arm 25. The turning shaft 38 is extended to the turning and elevating part 27 through the shaft part 26.

The turning and elevating part 27 includes a housing 41 continuously disposed on a lower part of the shaft part 26, and a turning mechanism 42 and an elevating mechanism 45 which are disposed inside the housing 41. The turning mechanism 42 has a motor for turning 43. A rotational shaft of the motor for turning 43 is connected to a lower end of the turning shaft 38. Thus, by driving the motor for turning 43 in rotation, the turning arm 25 fixed on the turning shaft 38 can be turned. The elevating mechanism 45 has: a support member 46 for rotatably supporting the turning shaft 38 through a bearing 47; a ball screw 48 with which the support member 46 is threadedly engaged, the ball screw 48 being extended vertically upward from a bottom part of the housing 41; a motor for elevation 49 for rotating the ball screw 48, the motor for elevation 49 being fixed on a bottom plate of the housing 41; and a guide member 50 for guiding the support member 46, the guide member 50 being vertically disposed in the housing 41. Namely, the elevating mechanism 45 can elevate and lower the turning shaft 38 by the ball screw mechanism, so as to elevated and lower the turning arm 25.

Figure 4:
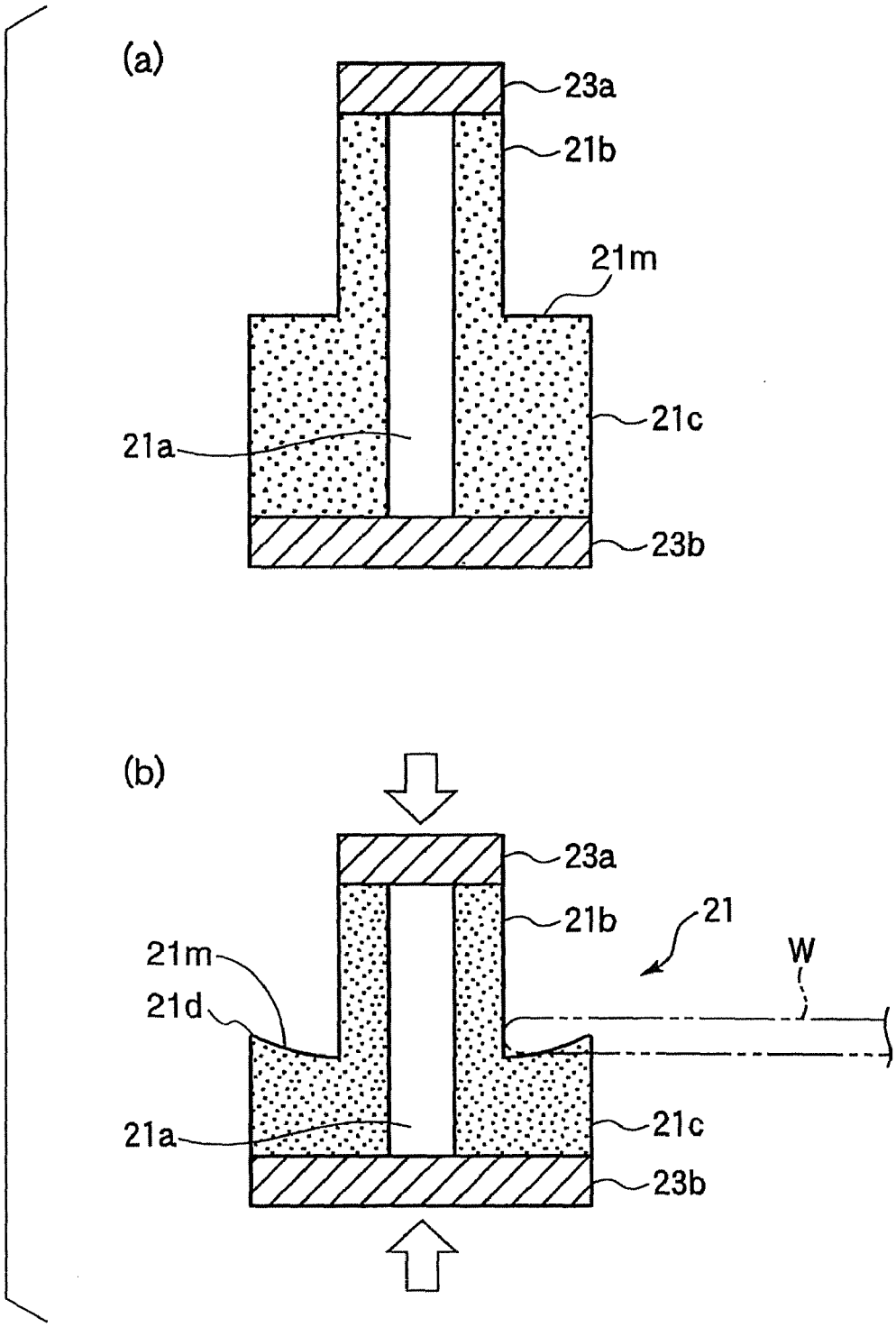
FIG. 4(*a*) is an enlarged sectional view of a brush of the cleaning mechanism provided on the substrate cleaning apparatus in the first embodiment according to the present invention, the brush being in an uncompressed state, and FIG. 4(*b*) is an enlarged sectional view of the brush in a compressed state.

FIG. 4(*a*) is an enlarged sectional view of the brush 21 in an uncompressed state, and FIG. 4(*b*) is an enlarged sectional view of the brush 21 in a compressed state. The brush 21 has a cylindrical small-diameter part 21*b*, and a cylindrical large-diameter part 21*c* that is continuous to a lower part of the small-diameter part 21*b*. A circumferential surface of the small-diameter part 21*b* serves as a cleaning part for cleaning an end surface of a wafer W. An upper surface of the large-diameter part 21*c*, i.e., a connection surface 21*m* between the large-diameter part 21*c* and the small-diameter part 21*b* serves as a cleaning part for cleaning a rear peripheral portion of a wafer W. In an actual cleaning, as show in FIG. 4(*b*), the brush 21 is pressed by the pressing members 23*a* and 23*b* so that the brush 21 is compressed and hardened. The wafer W is cleaned by such a compressed and hardened brush 21. As described above, the brush 21 is made of a sponge-like resin, and polyvinyl alcohol (PVA) may be preferably used as a resin. In addition, polyethylene (PE) may be used as an alternative resin for making the brush 21. Since the brush support member 21*a* and the pressing members 23*a* and 23*b* should have a certain degree of rigidity, a metal or a hard resin may be used therefor. However, since there is a possibility that a metal might contaminate a wafer W, a hard resin, such as polyether ether ketone (PEEK) and a polyethylene terephthalate (PET), is preferred.

Figure 5:
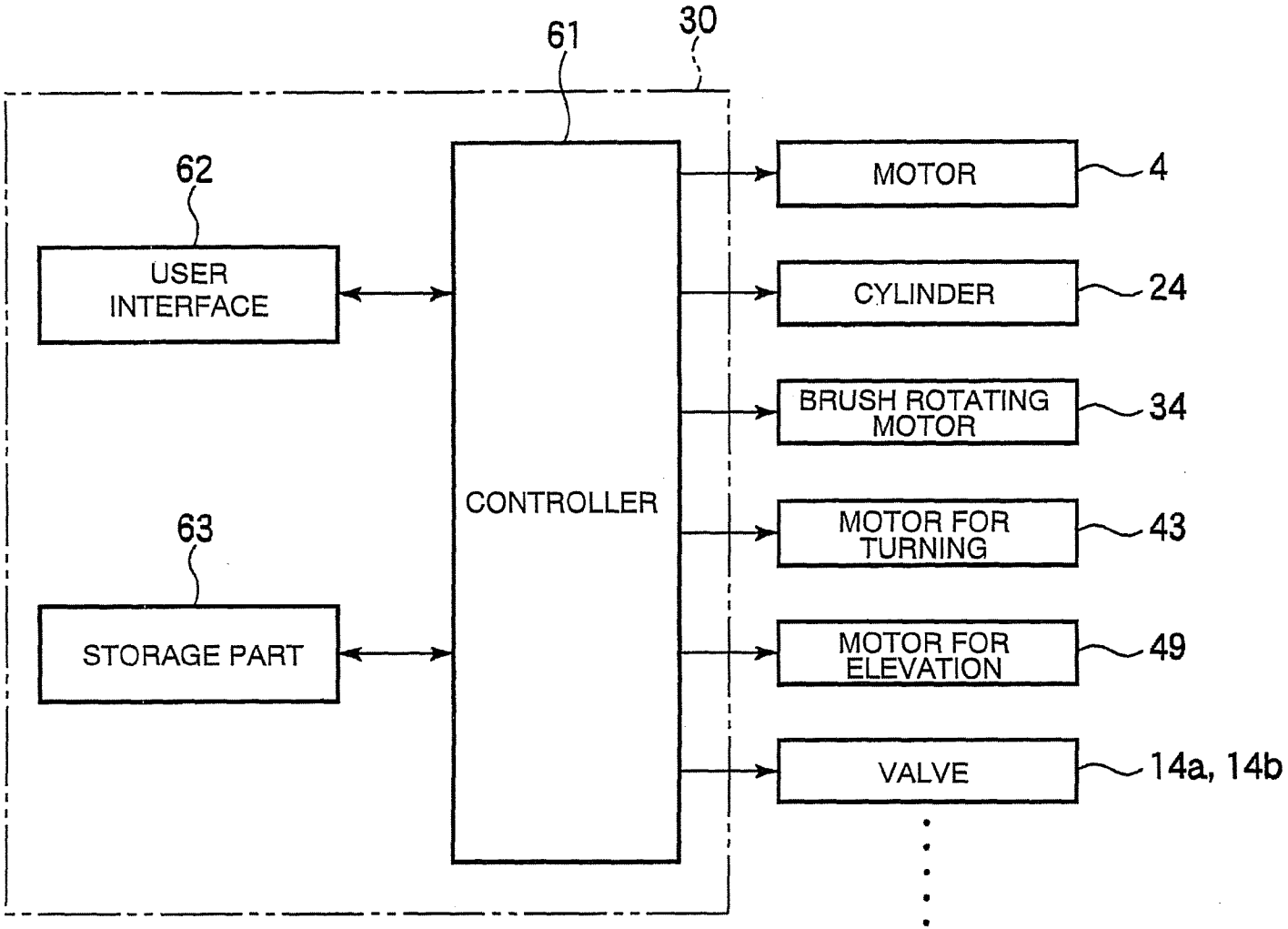
FIG. 5 is a block diagram showing a structure of a control part provided on the substrate cleaning apparatus in the first embodiment according to the present invention.

As shown in the block diagram of FIG. 5, the control part 30 includes a controller 61, a user interface 62, and a storage part 63. The controller 61 controls the respective structural elements of the substrate cleaning apparatus 1, e.g., the motor 4, the cylinder 24, the brush rotating motor 34, the motor for turning 43, and the motor for elevation 49. The user interface 62 is connected to the controller 61, and is composed of a keyboard by which an operator can input a command or the like for managing the wafer cleaning apparatus 1, and a display that displays a running condition of the wafer cleaning apparatus 1. The storage part 63 is also connected to the controller 61. The storage part 63 stores a control program for controlling the respective structural elements to be controlled of the wafer cleaning apparatus 1, and a program for making the wafer cleaning substrate 1 perform a predetermined process, i.e., a process recipe. The process recipe is stored in a storage medium of the storage part 63. The storage medium may be a hard disc which is of a fixed type, or may be a CD-ROM, a DVD, and a flash memory which are of a movable type. Alternatively, a recipe may be suitably transmitted from another apparatus through a dedicated line, for example. The controller 61 reads out and executes a given process recipe based on a command from the user interface 62, whereby a predetermined process is performed under the control of the controller 61.

Next, an operation for cleaning a wafer W by such a wafer cleaning apparatus 1 is described.

A wafer W is loaded into the chamber 2, and the wafer W is held by the spin chuck 3. Then, the pressing member 23*b* is moved upward by a predetermined distance by means of the cylinder 24, so that the brush 21 is sandwiched between the pressing members 23*a* and 23*b*. Then, the brush 21 is compressed and hardened. At this time, as shown in FIG. 4(*b*), both of the small-diameter part 21*b* and the large-diameter part 21*c* are compressed and hardened, and simultaneously therewith, the upper part of the large-diameter part 21*c* is deformed so that a projecting part 21*d* formed.

Under this state, the motor 4 is driven so as to rotate the wafer W together with the spin chuck 3 at a predetermined rotational speed. At the same time, while a cleaning liquid is being supplied from the front-side cleaning-liquid nozzle 11*a* and the rear-side cleaning-liquid nozzle 11*b*, the brush 21 and the brush support member 22 are rotated by the brush rotating motor 34. Then, the turning arm 25 is turned by the motor for turning 43 toward the wafer W on the spin chuck 3 such that an outer circumference of the small-diameter part 21*b* of the brush 21 is pressed onto an end surface of the wafer W, and a height of the turning arm 25 is adjusted by the elevating mechanism 45 such that the upper surface of the large-diameter part 21*c* of the brush 21 is pressed onto a rear peripheral portion of the wafer W. Then, the brush cleaning is started.

Not limited to the above, the following manner is possible. Namely, a position of the brush 21 is firstly adjusted by the motor for turning 43 and the elevating mechanism 45, and then the pressing member 23*b* is moved upward by a predetermined distance by means of the cylinder 24, whereby the brush 21 sandwiched between the pressing members 23*a* and 23*b* is compressed. Then, the brush 21 is pressed onto the end surface and the rear peripheral portion of the wafer W, and the cleaning is started.

At this time, since the sponge-like brush 21 is compressed to be hardened, a cleaning force of the brush 21 can be increased as compared with that of the brush 21 in the general state. Thus, deposits firmly adhering to the end surface and the rear peripheral portion of the wafer W can be removed. In addition, the upper surface of the large-diameter part 21*c* is deformed so that the projecting part 21*d* of a narrow area is formed. Thus, the rear peripheral portion of the wafer W can be locally cleaned by such a projecting part 21*d* having a significantly increased cleaning force. Namely, although the brush 21 is generally in surface contact with the wafer W, the brush 21 is in line contact with the wafer W due to the formation of the projecting part 21*d*. Thus, a pressure applied by the brush 21 to a part in contact therewith is remarkably raised.

Figure 6:
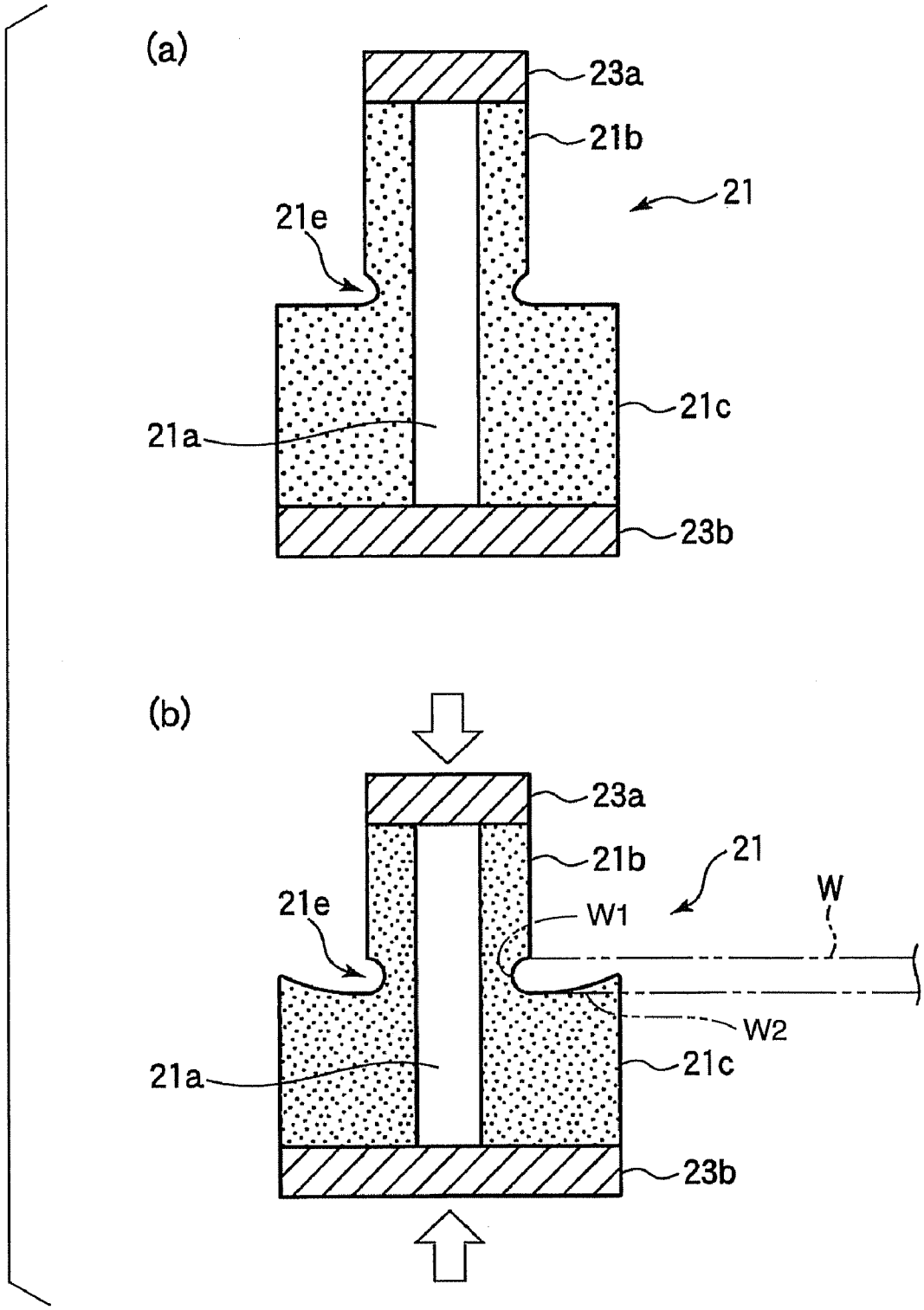
FIG. 6(*a*) is an enlarged sectional view of a modification of the brush shown in FIG. 4, which is in an uncompressed state, and FIG. 6(*b*) is an enlarged sectional view of the brush in a compressed state.
Figure 7:
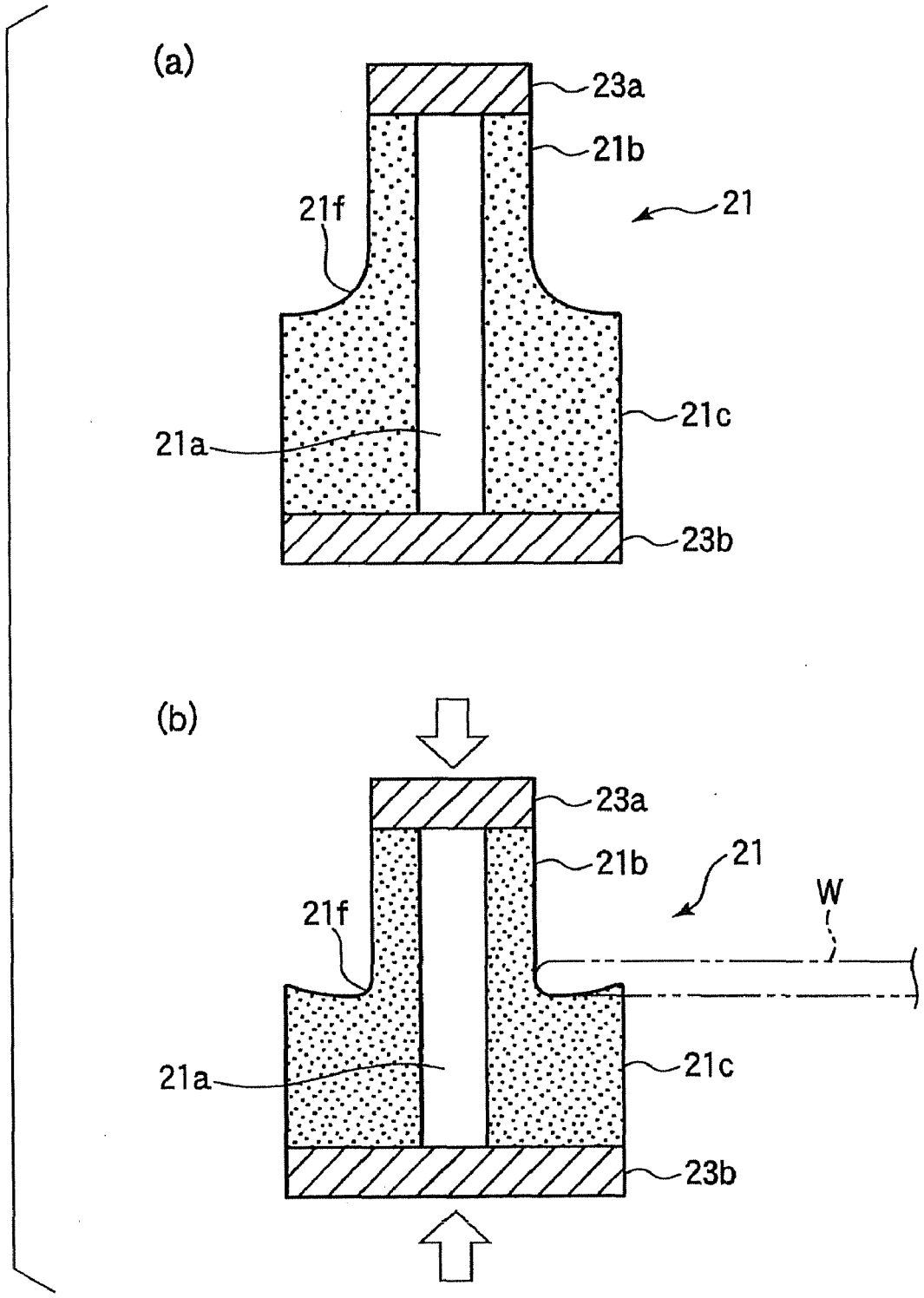
FIG. 7(*a*) is an enlarged sectional view of another modification of the brush shown in FIG. 4, which in an uncompressed state, and FIG. 7(*b*) is an enlarged sectional view of the brush in a compressed state.

A shape of the brush 21 may be determined in consideration of a deformation of the brush when compressed. Namely, an initial shape of the brush 21 is determined such that an excellent cleaning force can be obtained when the brush is compressed and deformed. For example, as shown in FIG. 6(*a*), a cutout 21*e* into which a wafer W can be inserted may be formed between the small-diameter part 21*b* and the large-diameter part 21*c*. In this case, as shown in FIG. 6(*b*), when the brush 21 is compressed, the brush 21 is deformed so as to surround an end surface W1 of a wafer W to be cleaned and a rear peripheral portion (W2) thereof, whereby the whole wafer W to be cleaned can be cleaned. In addition, since the brush 21 is collapsed, the pressure of the brush 21 is raised so that an overall cleaning force can be increased. Alternatively, as shown in FIG. 7(*a*), for example, a curved part 21*f* may be formed between the small-diameter part 21*b* and the large-diameter part 21*c*. Also in this case, as shown in FIG. 7(*b*), when the brush 21 is compressed, the brush 21 can be deformed to surround to a some degree an end surface and a rear peripheral portion of a wafer W to be cleaned, whereby the whole parts to be cleaned can be entirely cleaned. Since the brush 21 is also collapsed, the pressure of the brush 21 is raised so that an overall cleaning force of the brush 21 can be increased.

Figure 8:
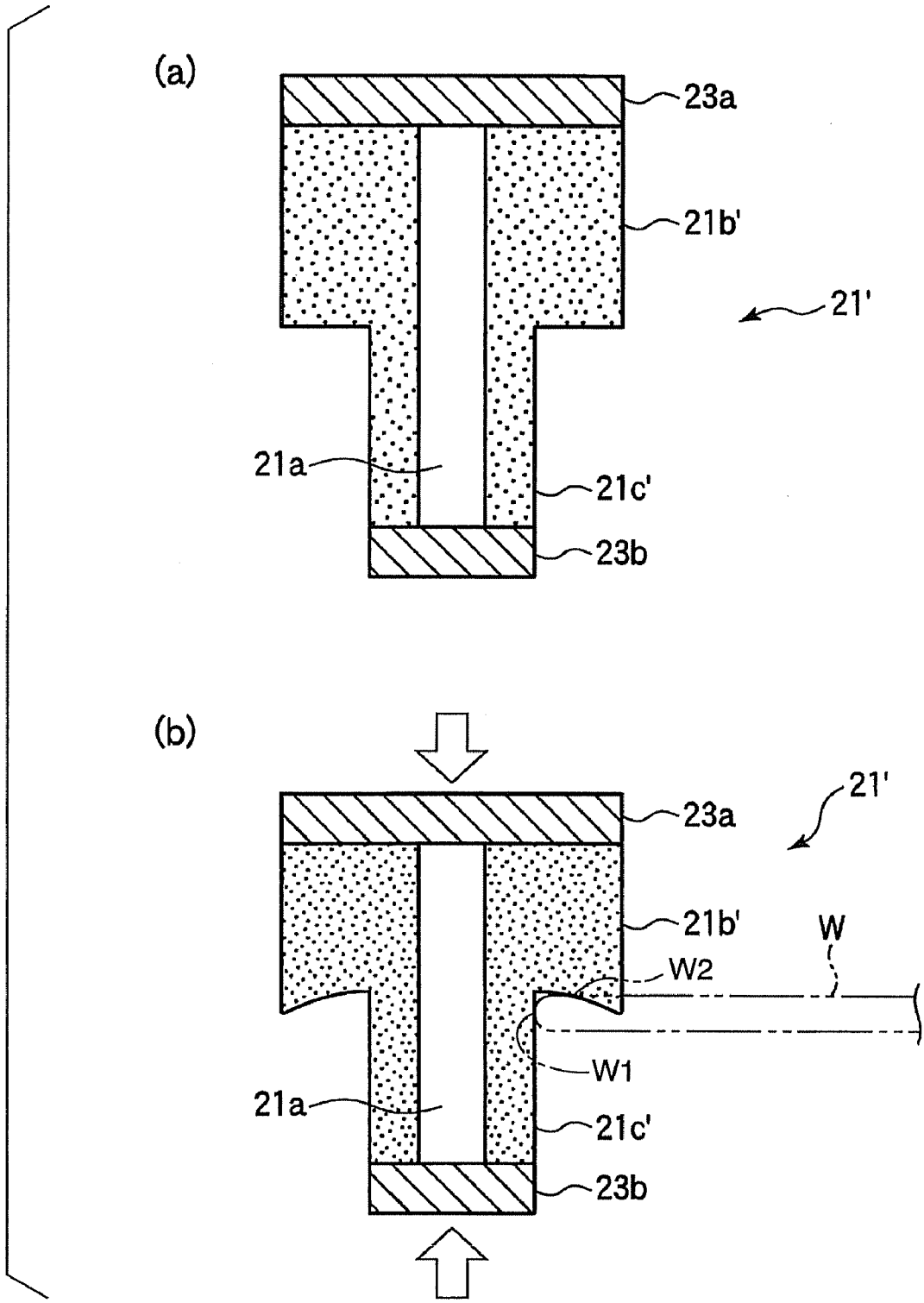
FIG. 8(*a*) is an enlarged sectional view of another structural example of the brush in an uncompressed state, and FIG. 8(*b*) is an enlarged sectional view of the brush in an compressed state.
Figure 9:
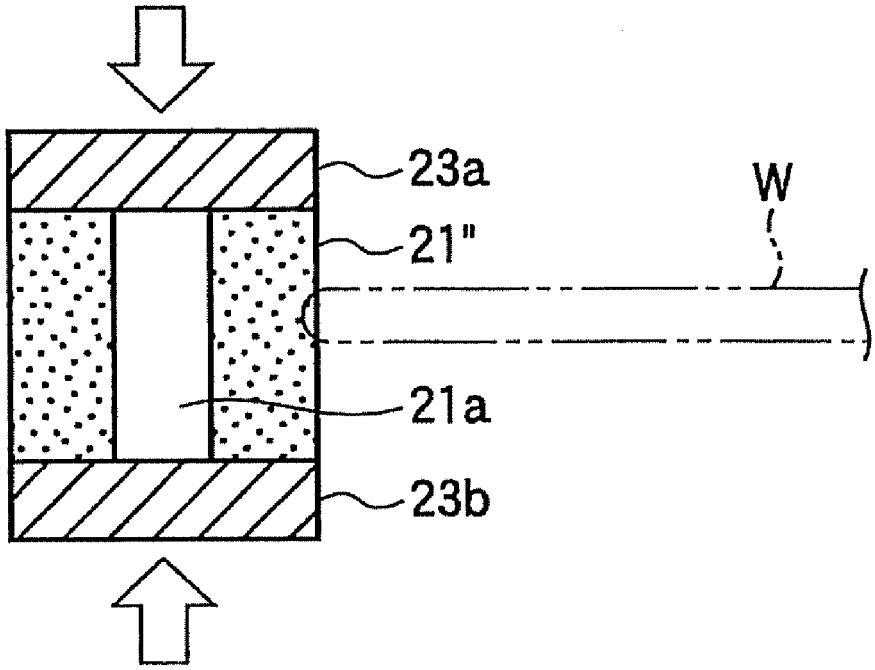
FIG. 9 is an enlarged sectional view of still another structural example of the brush.
Figure 10:
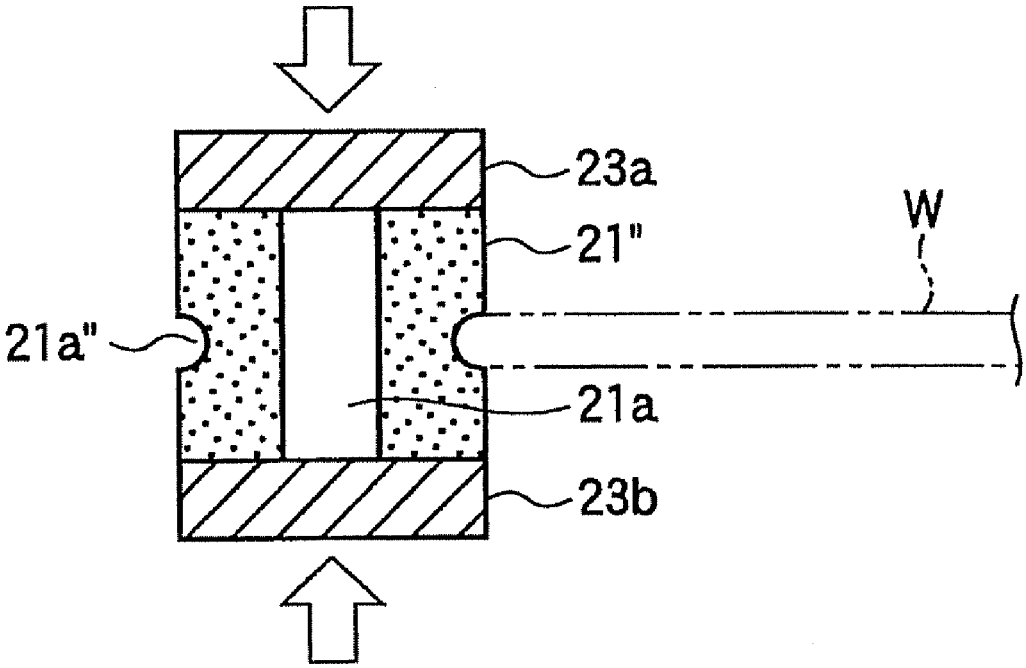
FIG. 10 is an enlarged sectional view of a modification of the brush shown in FIG. 9.

Not limited to the above embodiment, the present invention can be variously modified. For example, in the above embodiment, an end surface of a wafer and a rear peripheral portion thereof are cleaned by means of the brush having the upper small-diameter part and the lower large-diameter part, for example. However, as shown in FIG. 8(*a*), a brush 21' having an upper large-diameter pat 21*b*' and a lower small-diameter part 21*c*' may be used. As shown in FIG. 8(*b*), an end surface W1 and a front peripheral portion W2 of a wafer can be cleaned by vertically compressing the brush 21'. Also in this case, due to the structure formed by replacing the small-diameter part and the large-diameter part shown in FIGS. 6 and 7, the same effect as that of the structure shown in FIGS. 6 and 7 can be obtained. In addition, as shown in FIG. 9, there may be used a brush 21" having generally a cylindrical shape that cleans only an end surface of a wafer W. In this case, an initial shape of the brush 21" may be determined such that, when the brush 21" is compressed, an excellent cleaning force for at least an end surface of a wafer W is provided. As shown in FIG. 10, for example, a cutout 21*a*" into which a wafer W can be inserted may be formed in an outer circumferential surface of the brush 21".

In the above embodiment, although there has been described only the cleaning mechanism that cleans an end surface and a rear peripheral portion of a wafer is described, there may be provided a suitable cleaning mechanism that cleans a front surface of a wafer W. Further, not limited to the apparatus in the above embodiment, the present invention may be applied to a cleaning apparatus for cleaning a front surface and a rear surface of a wafer, and an apparatus for cleaning a rear surface of a wafer W.

Furthermore, the compressing method of the brush is not limited to the above embodiment, and various other methods may be employed. In addition, it is possible to previously compress a brush into a predetermined compressed state, and to mount the brush on an apparatus.

In addition, in the above embodiment, a semiconductor wafer is used as an object to be processed. However, not limited thereto, the present invention may be applied to another substrate such as a substrate for a flat panel display device, which is a typical example of a glass substrate for a liquid crystal display device.

Second Embodiment

Figure 11:
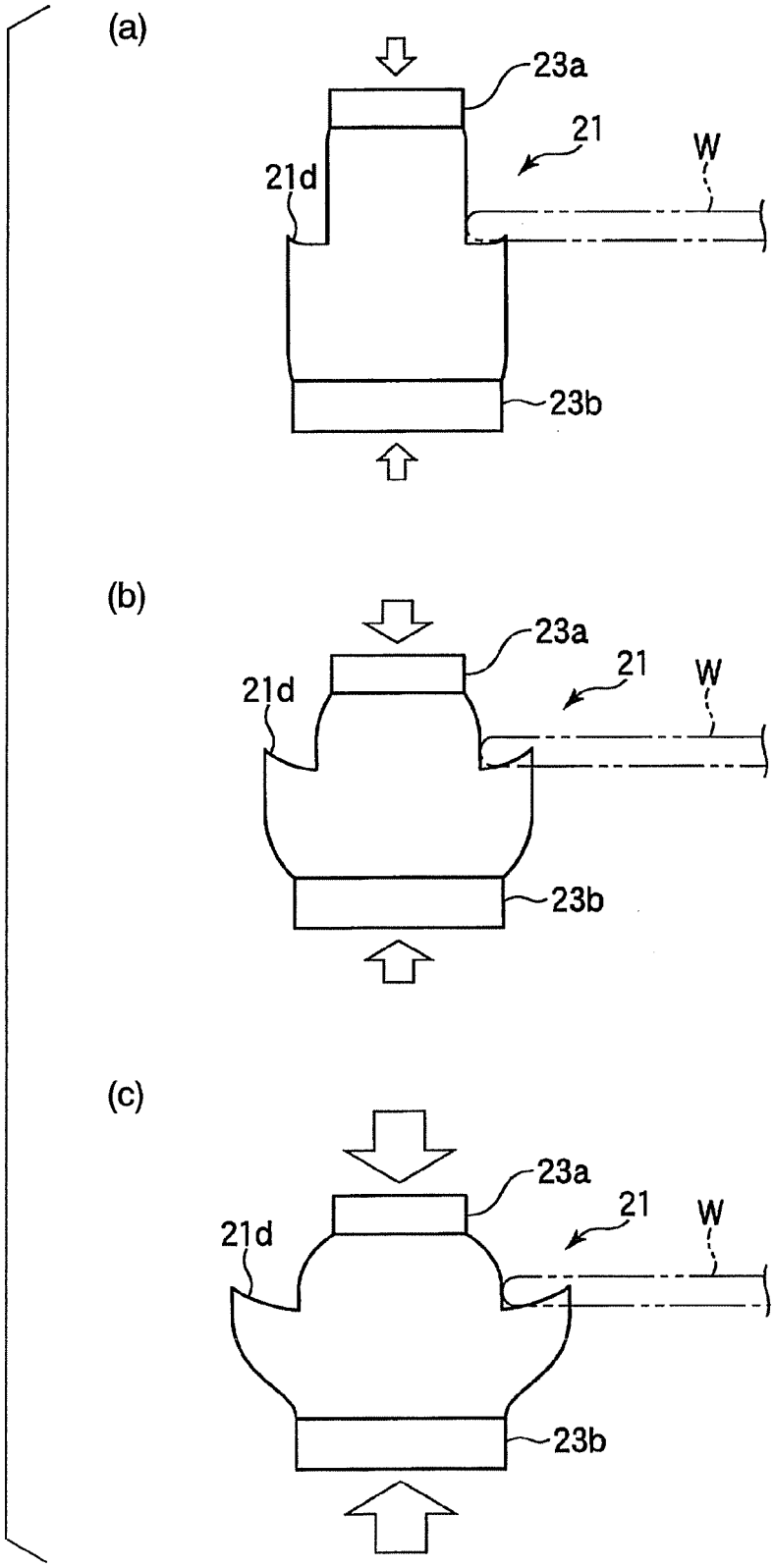
FIGS. 11(*a*) to (*c*) are a schematic views showing deformed state of a brush of a cleaning mechanism provided on a substrate cleaning apparatus in a second embodiment according to the present invention, while a compressive force applied thereto is varied.
Figure 12:
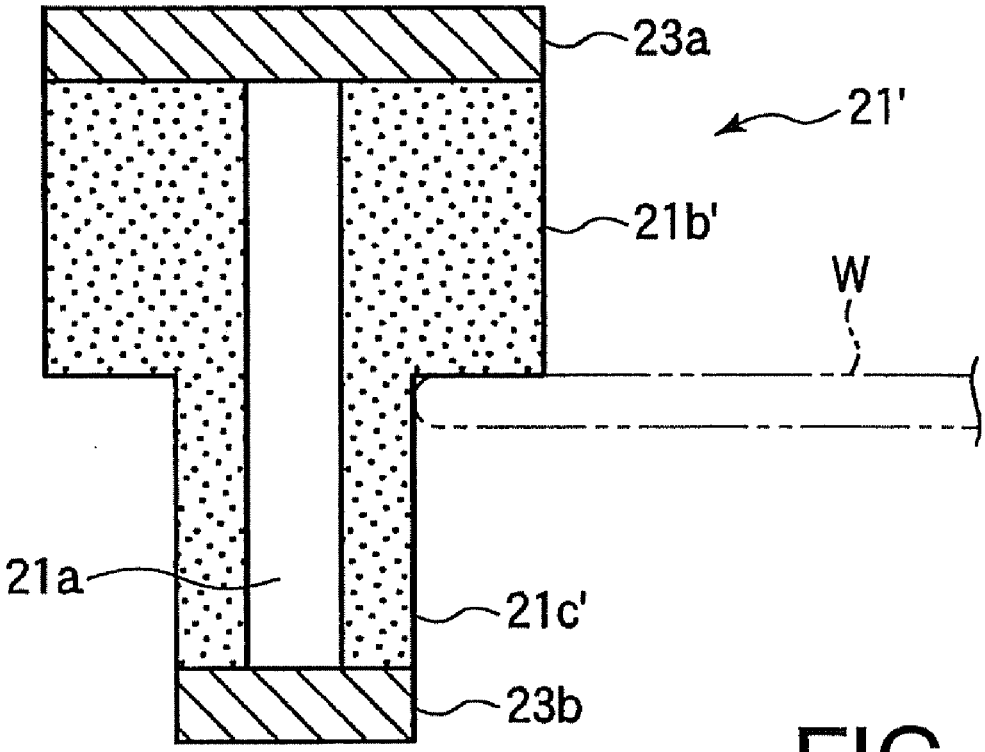
FIG. 12 is an enlarged sectional view of another structural example of the brush.
Figure 13:
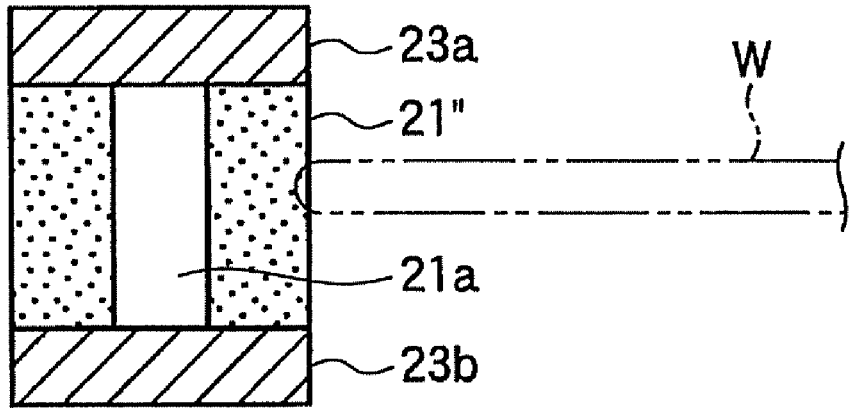
FIG. 13 is an enlarged sectional view of still another structural example of the brush.

Next, a second embodiment of the present invention is described with reference to FIGS. 11 to 13. In the second embodiment, the same parts as those of the first embodiment shown in FIGS. 1 to 10 are shown by the same reference numbers, and detailed description thereof is omitted.

In this embodiment, out of the functions of a control part 30 shown in FIG. 5, the function for controlling the cleaning of a wafer by varying a compressive force applied to a brush 21 is particularly important. Namely, based on a process recipe stored in a storage part 63, the cleaning of a wafer W is controlled such that a command is sent from a controller 61 to a cylinder 24 so as to vary a compressive force applied to the brush 21 by pressing members 23*a* and 23*b*. To be specific, it is possible to control the cleaning of a wafer W by varying the compressive force to the brush in real time during the cleaning. Alternatively, it is possible to control the cleaning of a wafer W by obtaining information about the state of a wafer W and making suitable the compressive force to the brush 21 depending on the information about the state of the wafer W.

The method for cleaning a wafer W by such a wafer cleaning apparatus 1 is described.

Firstly, the first method is described.

A wafer W is loaded into a chamber 2, and the wafer W is held by a spin chuck 3. At this time, the brush 21 is positioned at a waiting position, with a cleaning liquid being supplied thereto in order to prevent the brush 21 from being dried. Then, a compressed state of the brush 21 compressed by a cylinder 24 through the pressing members 23*a* and 23*b* is set to a predetermined initial state based on a process recipe.

After the brush 21 has been set to the initial state, a motor 4 is driven so as to rotate the wafer W together with the spin chuck 3 at a predetermined rotational speed. At the same time, while a cleaning liquid is being supplied from a front-side cleaning-liquid nozzle 11*a* and a rear-side cleaning-liquid nozzle 11*b*, the brush 21 and a brush support member 22 are rotated by a brush rotating motor 34. Then, the turning arm 25 is turned toward the wafer W on the spin chuck 3 such that an outer circumference of a small-diameter part 21*b* of the brush 21 is pressed onto an end surface of the wafer W, and a height of the turning arm 25 is adjusted by an elevating mechanism 45 such that an upper surface of a large-diameter part 21*c* of the brush 21 is pressed onto a rear peripheral portion of the wafer W. Then, the brush cleaning is started.

During this cleaning process, a compressive force applied to the brush 21 by the cylinder 24 is varied based on a process recipe. When a compressive force is applied to the brush 21 which is swelled with a cleaning liquid supplied thereto, a hardness of the brush 21 is raised as the compressive force is increased, whereby a cleaning force of the brush 21 is increased. On the other hand, when the hardness of the brush 21 is increased, a resilience thereof is decreased. Thus, an effect of the brush 21 that entirely cleans an end surface and a rear peripheral portion of a wafer W is degraded. Namely, the effect of the brush 21 for entirely cleaning a wafer W is upgraded when no compressive force is applied to the brush 21. Based on the features, the cleaning of a wafer W is controlled in the following manner. Namely, for example, in the initial state, no compressive force is applied to the brush 21, or a compressive force, which can provide about the same cleaning effect as that of the brush 21 to which no compressive force is applied, is applied to the brush 21. Under this state, an end surface and a rear peripheral portion of a wafer W is entirely cleaned by the brush 21 that is swelled with a cleaning liquid, so as to remove deposits adhering thereto not so firmly. Thereafter, the compressive force to the brush 21 is increased in a continuous manner or a stepwise manner, so as to increase the hardness of the brush 21. Thus, the cleaning force of the brush 21 is increased as time goes on, and deposits firmly adhering to the wafer W can be removed, whereby the end surface and the rear peripheral portion of the wafer W can be effectively cleaned. After the cleaning has been performed with the compressive force to the brush 21 having been increased, the compressive force is decreased until no compressive force is applied to the brush 21, or a compressive force, which can provide about the same cleaning effect as that of the brush 21 to which no compressive force is applied, is applied to the brush 21. Under this state, the wafer W is cleaned by the brush 21 swelled with a cleaning liquid, deposits which again adhere to the wafer W and remaining thereon can be entirely removed. Therefore, the cleaning effect can be further improved.

When the brush 21 is compressed, the hardness of the brush 21 is increased, and the upper surface of the large-diameter part 21*c* so that a projecting part 21*d* is formed, as shown in FIG. 4(*b*). Since the projecting part 21*d* of a narrow area is brought into contact with the rear peripheral portion of the wafer W, the wafer W is locally cleaned with the significantly increased cleaning force. Namely, although the brush 21 is generally in surface contact with the wafer W, the brush 21 is in line contact with the wafer due to the formation of the projecting part 21*d*, whereby a pressure applied by the brush 21 to a part in contact therewith is remarkably raised. In this case, as shown in FIG. 6, by varying the compressive force to the brush 21, a part of the wafer W with which the projecting part 21*d* comes into contact can be varied.

The method is described in more detail. FIG. 11(*a*) shows that a relatively small compressive force is applied, so that the brush 21 is not so collapsed. Thus, the projecting part 21*d* is small, and is formed at a position near to the end surface of the wafer W. As the compressive force is increased, the brush 21 is collapsed more and more, as shown in FIGS. 11(*b*) and 11(*c*). In accordance therewith, the projecting part 21*d* is enlarged, and is moved toward the center of the wafer W. In this manner, by increasing the compressive force to the brush 21, the position of the projecting part 21*d* can be moved. Namely, by varying the compressive force to the brush 21 during the cleaning process, a part to be cleaned by the projecting part 21 in the rear peripheral portion of the wafer W can be controlled, whereby an effective cleaning can be carried out.

Then, the second method is described.

In this method, a compressive force to the brush 21 is varied depending on a state of a wafer W to be cleaned. Depending on a process prior to the cleaning process and a type of a wafer W, the states of wafers W to be cleaned (adhering states of deposits to be removed) differ from each other.

Thus, in the second method, a state of a wafer W to be cleaned is previously set in a controller 61 of a control part 30, or a state of the wafer W to be cleaned is monitored by a suitable means and the information is sent to the controller 61. Then, a command is sent to the cylinder 24 and the brush 21 is compressed with a predetermined compressive force such that a cleaning state adapted for the state of the wafer W can be provided. When it is not necessary to compress the brush 21, the brush 21 cleans the wafer W, without being compressed.

After the brush 21 has been set in a predetermined state, a motor 4 is driven so as to rotate the wafer W together with a spin chuck 3 at a predetermined rotational speed. At the same time, while a cleaning liquid is being supplied from a cleaning liquid nozzle 11, the brush 21 and a brush support member 22 are rotated by a brush rotating motor 34. Then, the turning arm 25 is turned toward the wafer W on the spin chuck 3 such that an outer circumference of a small-diameter part 21*b* of the brush 21 is pressed onto an end surface of the wafer W, and a height of the turning arm 25 is adjusted by an elevating mechanism 45 such that an upper surface of a large-diameter part 21*c* of the brush 21 is pressed onto a rear peripheral portion of the wafer W. Then, the brush cleaning is started.

In this manner, the cleaning force is controlled by varying the compressive force to the brush 21 depending on the state of the wafer W. Thus, the wafer W can be appropriately cleaned, whereby an effective cleaning process can be achieved.

Not limited to the above embodiment, the present invention can be variously modified. For example, in the above embodiment, an end surface of a wafer and a rear peripheral portion thereof are cleaned by means of the brush having the upper small-diameter part and the lower large-diameter part. However, as shown in FIG. 12, a brush 21' having an upper large-diameter part 21*b*' and a lower small-diameter part 21*c*' may be used for cleaning an end surface and a front peripheral portion of a wafer. In addition, as shown in FIG. 13, there may be used a brush 21" having generally a cylindrical shape that cleans only an end surface of a wafer W.

Third Embodiment

A third embodiment of the present invention is described with reference to FIGS. 14 to 20. In the third embodiment, the same parts as those of the first embodiment shown in FIGS. 1 to 10 are shown by the same reference numbers, and detailed description thereof is omitted.

Figure 14:
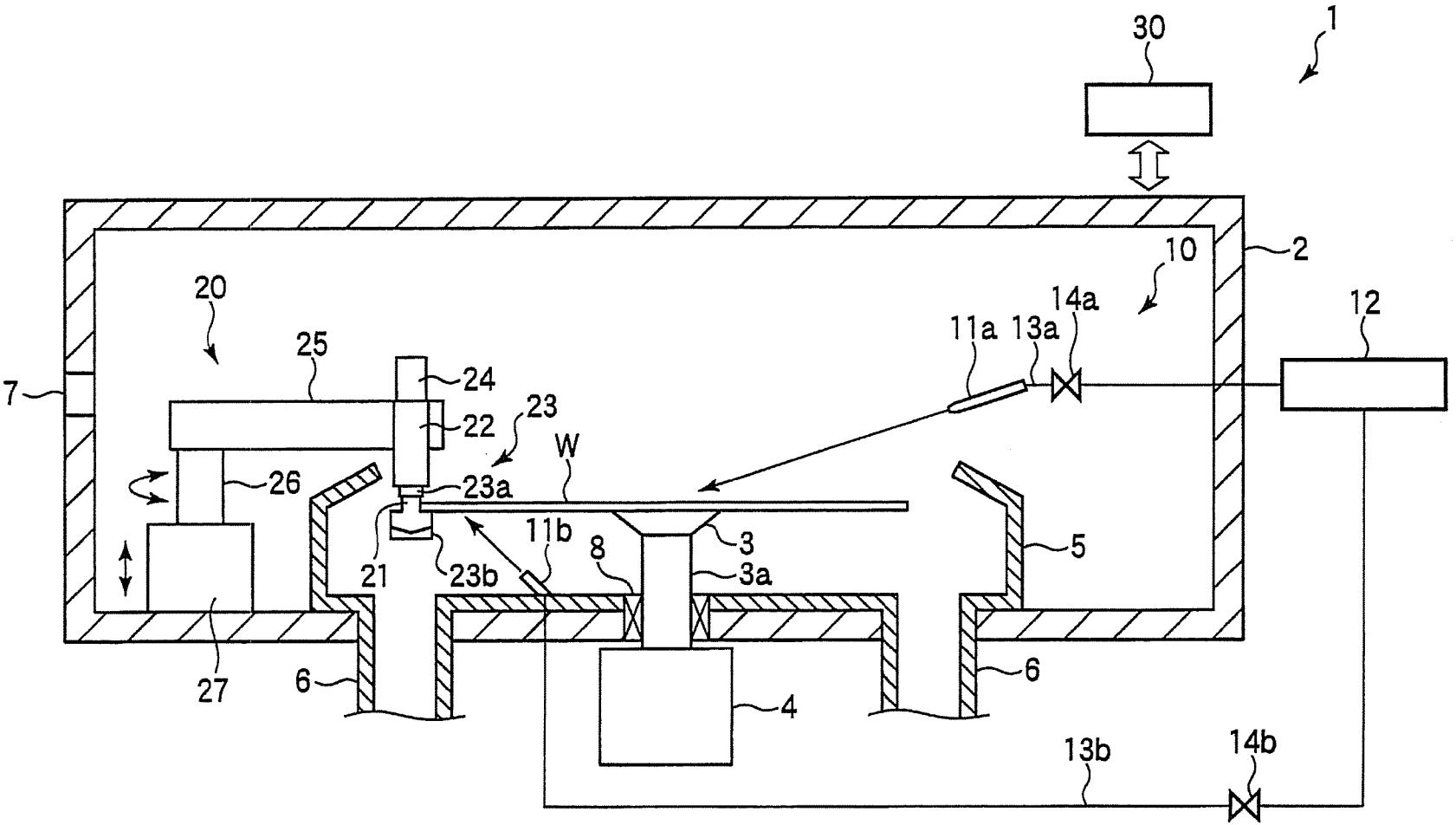
FIG. 14 is a schematic structural view showing a substrate cleaning apparatus in a third embodiment according to the present invention.

As shown in FIG. 14, a cleaning mechanism 20 includes: a brush 21 made of a sponge-like resin, the brush 21 being configured to clean a peripheral portion including an end surface of a wafer W; a rotational support member 22 configured to rotatably support the brush 21; a brush holding mechanism (brush compressing mechanism) 23 configured to hold the brush 21; a cylinder 24 configured to impart a holding force for holding the brush 21 or a compressive force for compressing the brush 21; a turning arm 25 configured turn the brush 21; a shaft part 26 incorporating a turning shaft serving as a turning axis of the turning arm 25; and a turning and elevating part 27 incorporating a turning mechanism configured to turn the turning arm 25 by rotating the turning shaft, and an elevating mechanism configured to elevate and lower (vertically move) the turning arm 25. The brush holding mechanism (brush compressing mechanism) 23 has a presser (pressing member) 23*a* configured to press the brush 21 from above, and a brush-shape deforming member (pressing member) 23*b* configured to be in contact with a lower surface of the brush 21 so as to deform a shape of the brush 21 into a predetermined shape.

Figure 15:
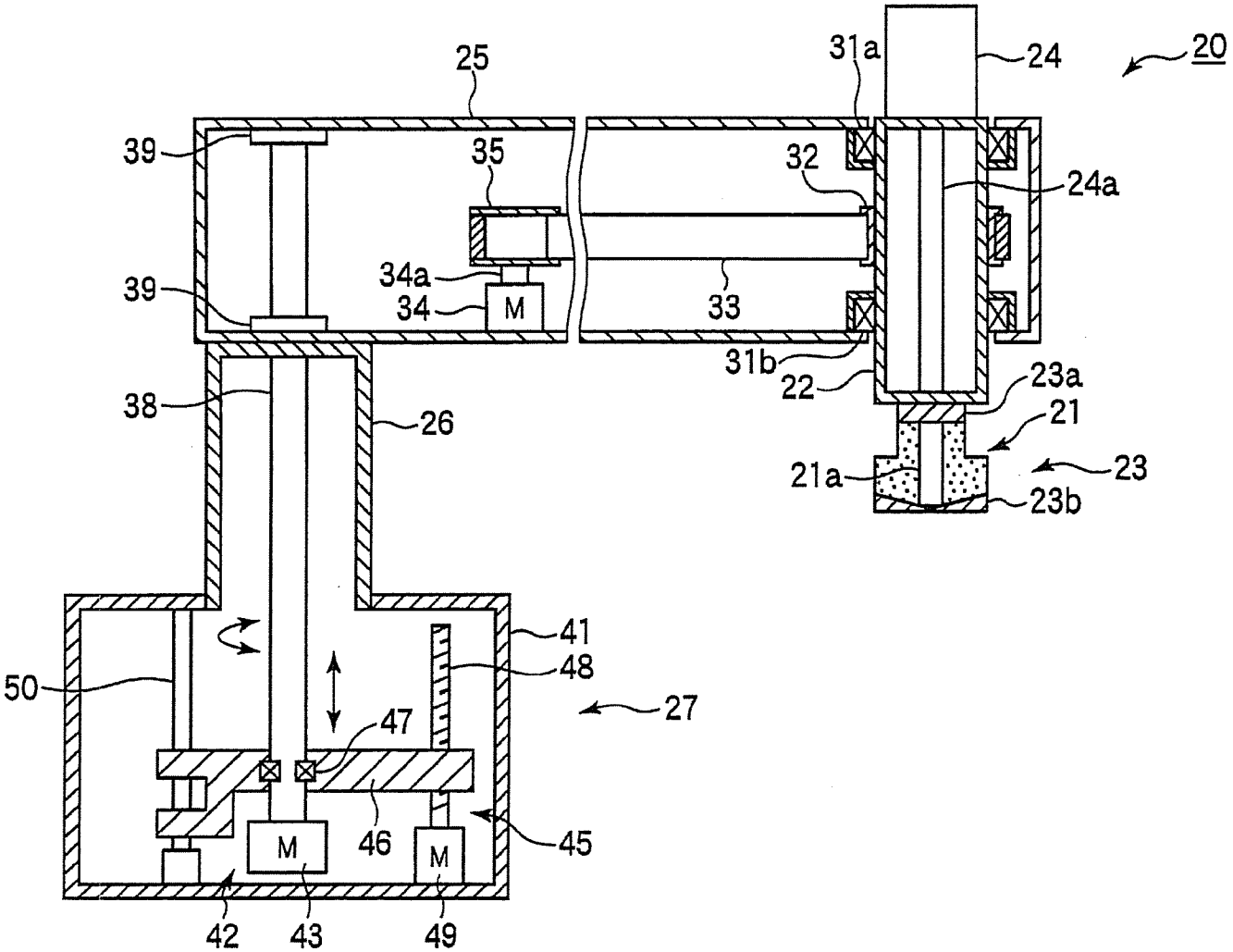
FIG. 15 is a sectional view showing in more detail a cleaning mechanism provided on the substrate cleaning apparatus in the third embodiment according to the present invention.

FIG. 15 is a sectional view showing in more detail the cleaning mechanism. The rotational support member 22 has a cylindrical shape that is vertically extended. A piston 24*a* of the cylinder 24 vertically passes an inside of the rotational support member 22. Connected to the piston 24*a* is a brush support shaft (brush support member) 21*a* that is vertically extended in a center of the brush 21. A lower end of the brush support shaft 21*a* is fixed on a center of the brush-shape deforming member 23*b*. The presser 23*a* is fixed on a lower end surface of the rotational support member 22, and a part between the brush support shaft 21*a* and the presser 23*a* is free. Thus, when the piston 24*a* of the cylinder 24 is withdrawn, the brush-shape deforming member 23*b* is elevated together with the brush support shaft 21*a*, so that the brush 21 is sandwiched and held between the presser 23*a* and the brush-shape deforming member 23*b*. When the piston 24*a* of the cylinder 24 is further withdrawn from this state, the brush 21 is compressed. Namely, the cylinder 24 functions as a brush compressing mechanism. Both of the presser 23*a* and the brush-shape deforming member 23*b* may be moved to hold or compress the brush 21. In addition, another actuator may be used instead of the cylinder 24.

Figure 16:
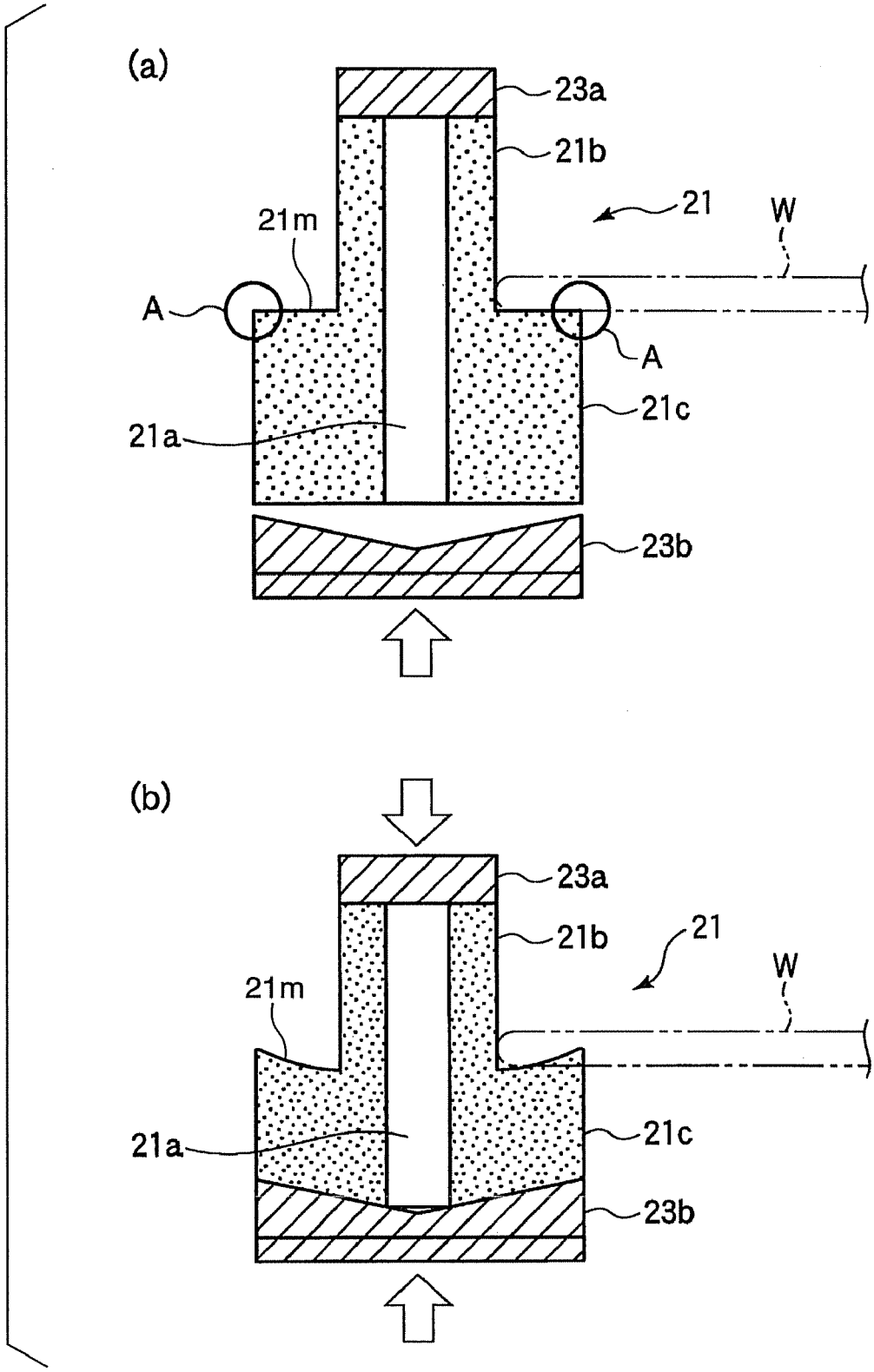
FIG. 16(*a*) is an enlarged sectional view of the brush and a third example of a brush-shape deforming member of the cleaning mechanism provided on the substrate cleaning apparatus in the third embodiment according to the present invention, and FIG. 16(*b*) is a sectional view of the brush in a compressed state.

FIG. 16 is an enlarged sectional view of the brush 21. The brush 21 has a cylindrical small-diameter part 21*b*, and a cylindrical large-diameter part 21*c* that is continuous to a lower part of the small-diameter part 21*b*. A circumferential surface of the small-diameter part 21*b* serves as a cleaning part for cleaning an end surface of a wafer W. An upper surface of the large-diameter part 21*c*, i.e., a connection surface 21*m* between the large-diameter part 21*c* and the small-diameter part 21*b* serves as a cleaning part for cleaning a rear peripheral portion of a wafer W.

As described above, since the lower surface of the brush 21 is capable of being in contact with the brush-shape deforming member 23*b*, the shape of the brush 21 can be deformed by the brush-shape deforming member 23*b* such that the brush 21 can perform a desired cleaning. Namely, as shown in FIG. 16(*a*), for example, the brush-shape deforming member 23*b* has a concaved shape. When the brush 21, which is held by the brush-shape deforming member 23*b* of this shape, is pressed and held by the presser 23*a*, the shape of the brush 21 is deformed so that an outer peripheral portion of the sponge-like brush 21 is more compressed as compared with an inner peripheral portion thereof. Since the outer peripheral portion becomes harder than the inner peripheral portion, a cleaning force of the part depicted by the character A is increased. Thus, when the cleaning force of the part A is desired to be increased, the use of the brush-shape deforming member 23*b* of a concaved shape can provide an effective cleaning. As shown in FIG. 16(*b*), by moving the piston 24*a* by the cylinder 24 so as to apply a compressive force, which is greater than the holding force, to the brush 21, the brush 21 is hardened as a whole, so that the cleaning force is more increased.

Figure 17:
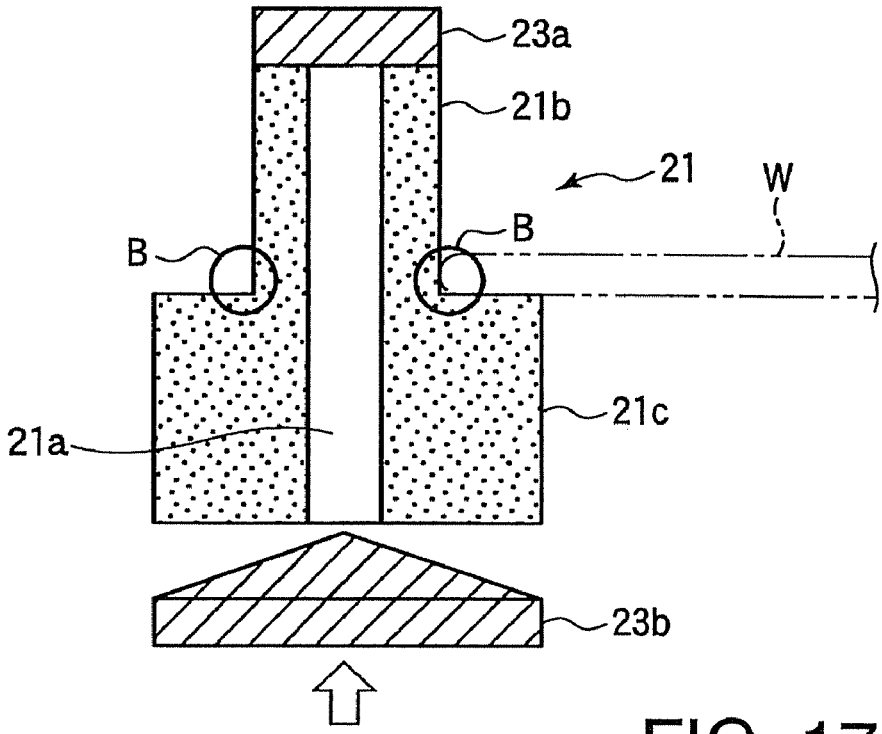
FIG. 17 is an enlarged sectional view of the brush and another example of the brush-shape deforming member of the cleaning mechanism provided on the substrate cleaning apparatus in the third embodiment according to the present invention.

FIG. 17 shows that the brush-shape deforming member 23*b* has a conical shape. When the brush 21, which is held by the brush-shape deforming member 23*b* of this shape, is pressed and held by presser 23*a*, the shape of the brush 21 is deformed such that the inner peripheral portion of the sponge-like brush 21 is more compressed as compared with the outer peripheral portion thereof. Since the inner peripheral portion becomes harder than the outer peripheral portion, a cleaning force of the part depicted by the character B is increased. Thus, when the cleaning force of the part B is desired to be increased, the use of the brush-shape deforming member 23*b* of a conical shape can provide an effective cleaning.

Figure 18:
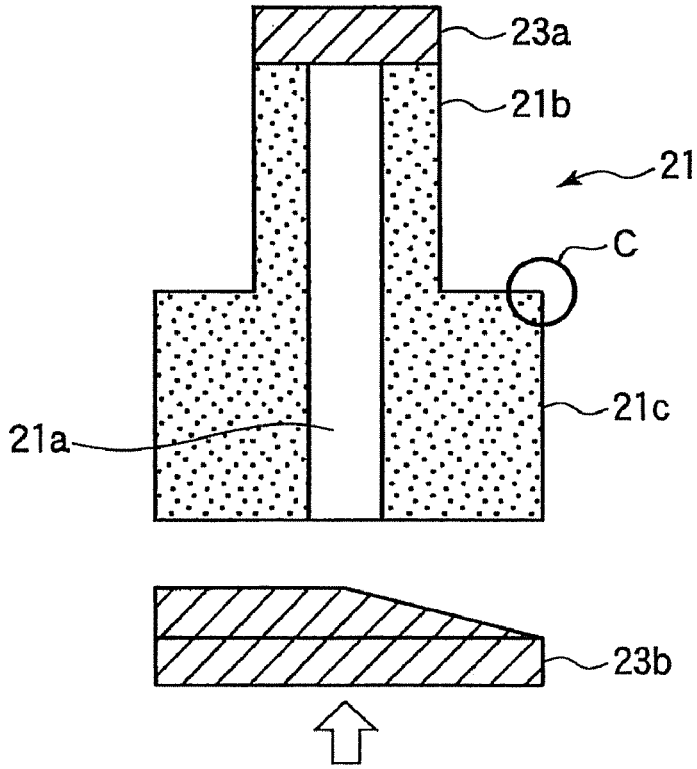
FIG. 18 is an enlarged sectional view of the brush and still another example of the brush-shape deforming member of the cleaning mechanism provided on the substrate cleaning apparatus in the third embodiment according to the present invention.
Figure 19:
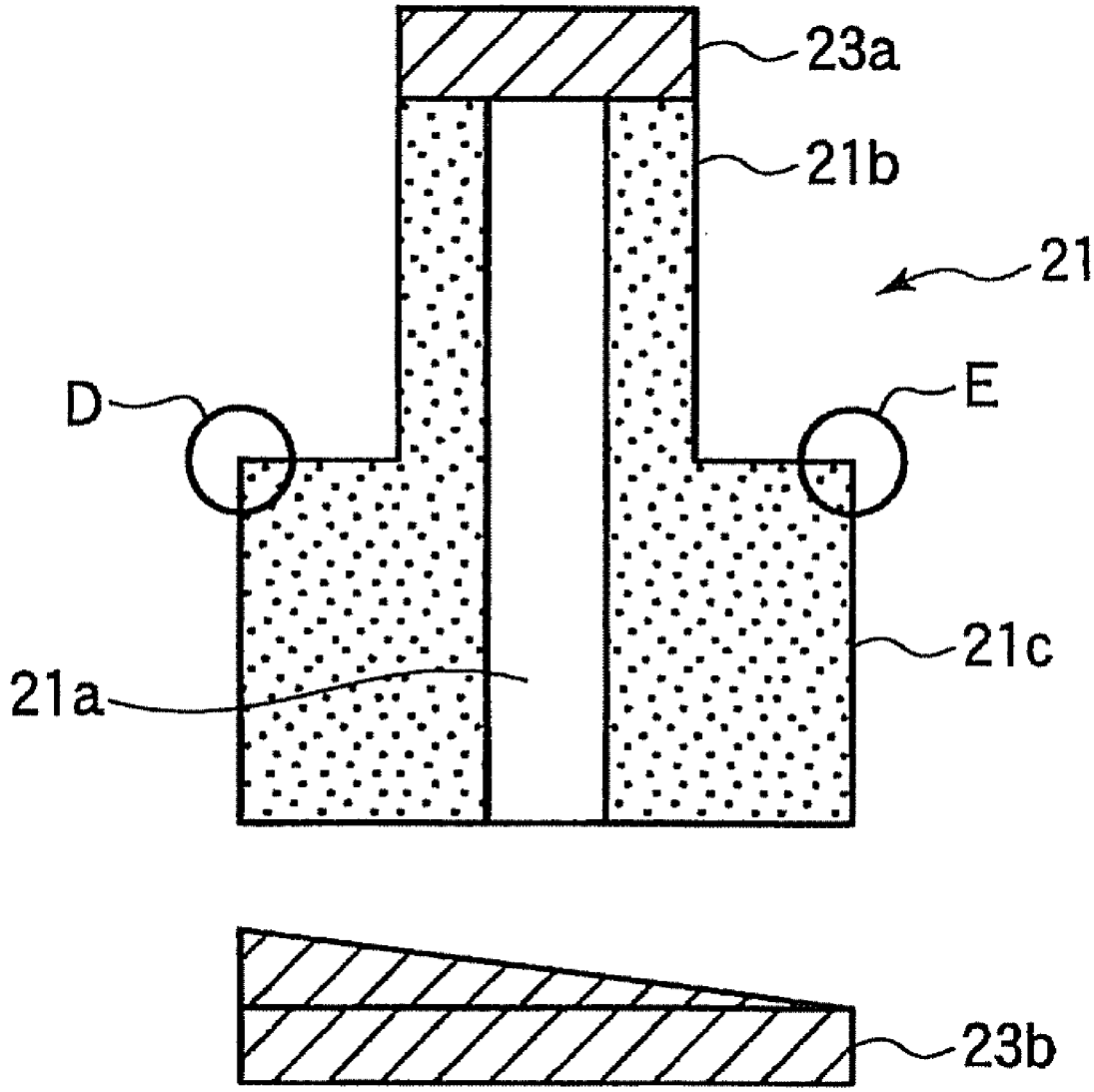
FIG. 19 is an enlarged sectional view of the brush, an alternative example of the brush-shape deforming member, and a brush support member of the cleaning mechanism provided on the substrate cleaning apparatus in the third embodiment according to the present invention.

FIGS. 18 and 19 show the brush-shape deforming member 23*b* having an asymmetric shape with respect to the rotational axis. With the use of such a brush-shape deforming member 23*b*, parts of the brush 21 of different cleaning properties are continuously brought into contact with a wafer W by rotating the brush 21, whereby the wafer W can be effectively cleaned. To be specific, in FIG. 18, the brush-shape deforming member 23*b* has a shape including a flat part and a part declined outward. Thus, a compressive degree of a part C becomes smaller, and the flat part and the declined part are alternately brought into contact with a wafer W. In FIG. 19, the brush-shape deforming member 23*b* has a successively inclined shape. Thus, a compressive degree is linearly varied from a part D to a part E, and thus a cleaning degree of a wafer W is linearly varied.

In FIGS. 16 to 19, the brush-shape deforming member 23*b* for deforming the shape of the brush 21 and the brush support shaft 21*a* are actually arranged in position such that the brush-shape deforming member 23*b* and the brush support shaft 21*a* do not interfere with each other.

As described above, the brush 21 is made of a sponge-like resin, and polyvinyl alcohol (PVA) may be preferably used as a resin. In addition, polyethylene (PE) may be used as an alternative resin for making the brush 21. Since the brush support shaft 21*a*, the presser 23*a*, and the brush-shape deforming member 23*b* should have a certain degree of rigidity, a metal or a hard resin may be used therefor. However, since there is a possibility that a metal might contaminate a wafer W, a hard resin, such as polyether ether ketone (PEEK) and a polyethylene terephthalate (PET), is preferred.

Next, an operation for cleaning a wafer W by such a wafer cleaning apparatus 1 is described.

Firstly, the shape of the brush-shape deforming member 23*b* is selected such that the brush 21 can perform a desired cleaning depending on a state of deposits adhering to a substrate to be cleaned. Then, the brush 21 is sandwiched and held between the brush-shape deforming member 23*b* and the presser 23*a*. For example, the brush-shape deforming member 23*a* having one of the shapes shown in FIGS. 16 to 19 is used.

Under this state, the motor 4 is driven so as to rotate the wafer W together with the spin chuck 3 at a predetermined rotational speed. At the same time, while a cleaning liquid is being supplied from the cleaning liquid nozzle 11, the brush 21 and the brush support member 22 are rotated by the brush rotating motor 34. Then, the turning arm 25 is turned by the motor for turning 43 toward the wafer W on the spin chuck 3 such that an outer circumference of the small-diameter part 21*b* of the brush 21 is pressed onto an end surface of the wafer W, and a height of the turning arm 25 is adjusted by the elevating mechanism 45 such that the upper surface of the large-diameter part 21*c* of the brush 21 is pressed onto a rear peripheral portion of the wafer W. Then, the brush cleaning is started.

For example, when a larger number of deposits adhere to a portion nearer to a center than a rear peripheral portion of a wafer W, by using the brush-shape deforming member 23*b* shown in FIG. 16, the outer peripheral portion of the brush 21 is compressed to deform the shape of the brush 21 such that the part A of the brush 21 is hardened. Since the cleaning force of the part A is increased, an effective cleaning can be achieved.

When a larger number of deposits adhere to a portion near to an end surface of a wafer W, by using the brush-shape deforming member 23*b* shown in FIG. 17, the central portion of the brush 21 is compressed to deform the shape of the brush 21 such that the part B of the brush 21 is hardened. Since the cleaning force of the part B is increased, an effective cleaning can be achieved.

In addition, when there is used the brush-shape deforming member having an asymmetric shape with respect to the rotational axis, as shown in FIGS. 18 and 19, the shape of the brush 21 is varied while the brush 21 is being asymmetrically compressed. Thus, by rotating the brush 21, parts of the brush having different cleaning properties are continuously brought into contact with the wafer W, whereby the wafer W is effectively cleaned.

In all the aforementioned cases, by moving further upward the brush-shape deforming member 23*b* by the cylinder 24 so as to apply a compressive force to the brush 21, the hardness of the whole brush 21 is increased, whereby the cleaning force is increased as compared with that of the brush 21 in the general state. Thus, deposits firmly adhering to an end surface and a rear peripheral portion of a wafer W can be removed.

Figure 20:
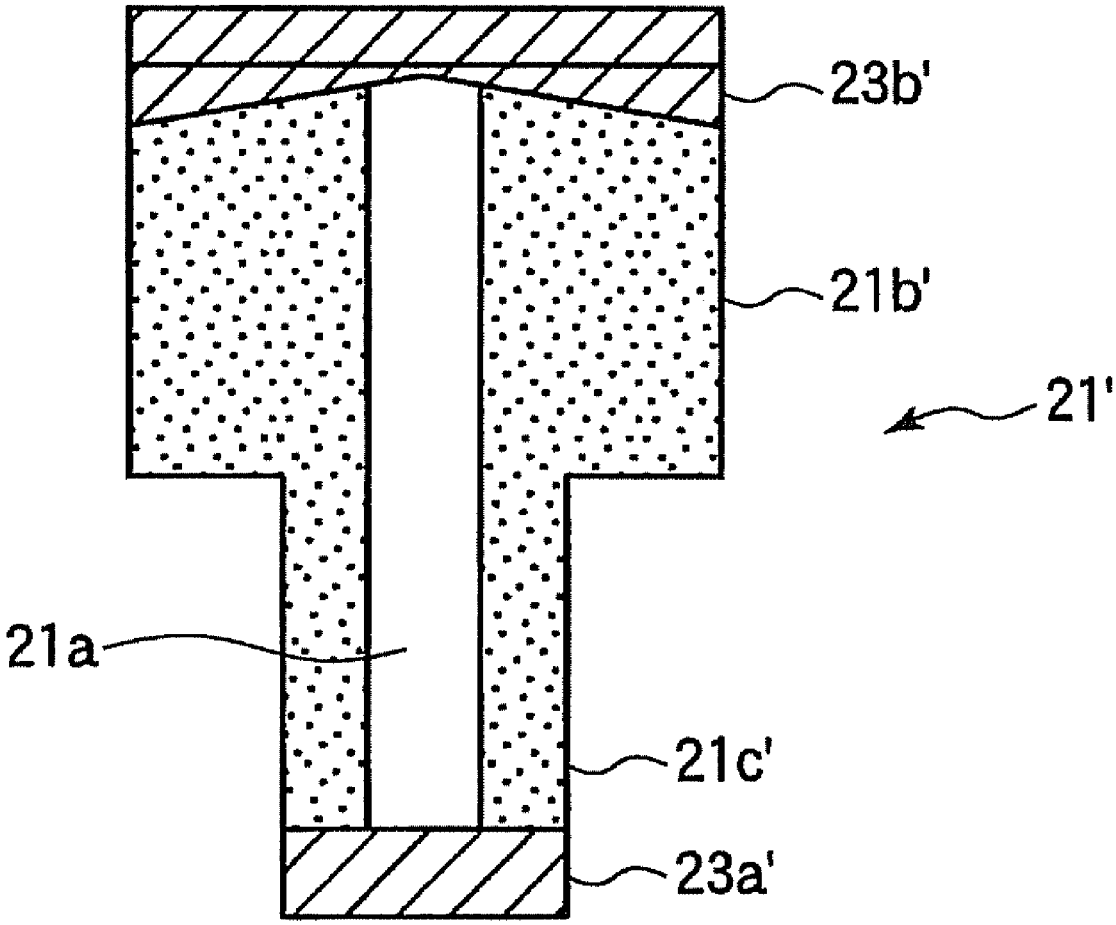
FIG. 20 is an enlarged sectional view of another structural example of the brush.

Not limited to the above embodiment, the present invention can be variously modified. For example, in the above embodiment, an end surface of a wafer and a rear peripheral portion thereof are cleaned by means of the brush having the upper small-diameter part and the lower large-diameter part, for example. However, as shown in FIG. 20, a brush 21' having an upper large-diameter pat 21*b*' and a lower small-diameter part 21*c*' may be used. By bringing an upper surface of the brush 21' into contact with a brush-shape deforming member 23*b*' and by pressing a lower surface thereof by a presser 23*a*', an end surface and a front peripheral portion of a wafer W may be cleaned.

Not limited to the aforementioned shapes, the brush-shape deforming member may take various other shapes in order to obtain a desired cleaning.

In the above embodiment, although there has been described only the cleaning mechanism that cleans an end surface and a rear peripheral portion of a wafer, there may be provided another suitable cleaning mechanism that cleans a front surface of a wafer W. Not limited to the apparatus in the above embodiment, the present invention may be applied to a cleaning apparatus for cleaning a front surface and a rear surface of a wafer W and an apparatus for cleaning a rear surface of a wafer W.

The brush holding mechanism is not limited to the above embodiment. For example, it is possible to prepare a brush which is previously sandwiched between a brush-shape deforming member and a presser, and to mount the brush on an apparatus.

The invention claimed is:

1. A substrate cleaning apparatus for cleaning a substrate having an end surface, a front peripheral portion and a rear peripheral portion, the substrate cleaning apparatus comprising:

a substrate holding mechanism configured to rotatably hold a substrate;

a substrate rotating mechanism configured to rotate the substrate held by the substrate holding mechanism;

a cleaning-liquid supply mechanism configured to supply a cleaning liquid to the substrate held by the substrate holding mechanism;

a cleaning mechanism including a brush made of a sponge-like resin, which is brought into contact with at least an end surface of the substrate during the cleaning, and a brush compressing mechanism configured to compress the brush;

a horizontally moving part configured to horizontally move the cleaning mechanism; and a vertically moving part configured to vertically move the cleaning mechanism, wherein the brush is made to be in contact with and to clean at least the end surface of the substrate by the horizontally moving part and the vertically moving part, under a state in which the brush is compressed and hardened by the brush compressing mechanism and the brush compressing mechanism is independent or the horizontally moving part and the vertically moving part.

2. The substrate cleaning apparatus according to claim 1, wherein:

the brush includes a cylindrical small-diameter part and a cylindrical large-diameter part continuous to the small-diameter part;

the end surface of the substrate is cleaned by a circumferential surface of the small-diameter part; and the rear peripheral portion or the front peripheral portion of the substrate is cleaned by a connection surface between the large-diameter part and the small-diameter part.

3. The substrate cleaning apparatus according to claim 2, wherein the connection surface between the large-diameter part and the small-diameter part is deformed by compressing the brush, and the rear peripheral portion or the front peripheral portion of the substrate is locally cleaned by the deformed part.

4. The substrate cleaning apparatus according to claim 2, wherein an initial shape of the brush is determined such that an excellent cleaning force for the end surface and the front peripheral portion or the rear peripheral portion of the substrate is provided, when the brush is compressed by the brush compressing mechanism.

5. The substrate cleaning apparatus according to claim 4, wherein the initial shape of the brush has, between the small-diameter part and the large-diameter part, a cutout into which the substrate can be inserted.

6. The substrate cleaning apparatus according to claim 4, wherein the initial shape of the brush has a curved part between the small-diameter part and the large-diameter part.

7. The substrate cleaning apparatus according to claim 1, wherein the brush has a cylindrical shape, and the end surface of the substrate is cleaned by an outer circumferential surface of the brush.

8. The substrate cleaning apparatus according to claim 7, wherein an initial shape of the brush is determined such that an excellent cleaning force for at least the end surface of the substrate is provided, when the brush is compressed by the brush compressing mechanism.

9. The substrate cleaning apparatus according to claim 8, wherein the initial shape of the brush has, in an outer circumference thereof, a cutout into which the substrate can be inserted.

10. The substrate cleaning apparatus according to claim 1, wherein the brush compressing mechanism includes a pair of pressing members configured to vertically sandwich the brush therebetween, and an actuator configured to move at least one of the pressing members.

11. The substrate cleaning apparatus according to claim 1, wherein: the cleaning mechanism includes a brush rotating mechanism configured to rotate the brush, and a brush moving mechanism configured to move the brush close to and apart from the substrate; and the brush, which is rotated by the brush rotating mechanism, is brought into contact with the substrate, which is rotated by the substrate rotating mechanism, by the brush moving mechanism so that at least the end surface of the substrate is cleaned under this state.

12. The substrate cleaning apparatus according to claim 1, further comprising a control part configured to control the brush cleaning, by varying a compressive force applied by the brush compressing mechanism to the brush.

13. The substrate cleaning apparatus according to claim 12, wherein;

the brush has a cylindrical small-diameter part and a large-diameter part having a connection surface between the large-diameter part and the small-diameter part;

the connection surface between the large-diameter part and the small-diameter part is deformed by compressing the brush;

the front peripheral portion or the rear peripheral portion of the substrate can be locally cleaned by the deformed part; and the control part controls a position of the deformed part by varying the compressive force applied by the brush compressing mechanism.

14. The substrate cleaning apparatus according to claim 12, wherein the control part controls the brush cleaning by varying the compressive force to the brush by the brush compressing mechanism during the cleaning of the substrate.

15. The substrate cleaning apparatus according to claim 12, wherein the control part controls the brush cleaning by varying the compressive force to the brush depending on a state of the substrate to be cleaned.

16. The substrate cleaning apparatus according to claim 1, wherein the brush compressing mechanism includes a brush-shape deforming member configured be in contact with the brush so as to deform a shape of the brush into a predetermined shape.

17. The substrate cleaning apparatus according to claim 16, wherein:

the brush includes a cylindrical small-diameter part and a cylindrical large diameter part having a connection surface between the large-diameter part and the small-diameter part; and the brush-shape deforming member deforms the connection surface into a predetermined state such that a desired cleaning can be achieved.

18. The substrate cleaning apparatus according to claim 16, wherein a contact surface of the brush-shape deforming member to be in contact with the brush has a concaved shape.

19. The substrate cleaning apparatus according to claim 16, wherein a contact surface of the brush-shape deforming member to be in contact with the brush has a conical shape.

20. The substrate cleaning apparatus according to claim 16, wherein a contact surface of the brush-shape deforming member to be in contact with the brush has an asymmetric shape with respect to a rotational axis of the brush.

21. The substrate cleaning apparatus according to claim 1, further comprising an arm, wherein the cleaning mechanism is provided on one side of the arm and the horizontally moving part and vertically moving part are provided on the other side of the arm, such that the horizontally moving part moves the arm horizontally and the vertically moving part moves the arm vertically.

* * * * *